US006276239B1

(12) United States Patent
Albertson

(10) Patent No.: US 6,276,239 B1
(45) Date of Patent: Aug. 21, 2001

(54) HAND TOOL

(76) Inventor: David V. Albertson, 3124 Brooks La., Minnetonka Beach, MN (US) 55361

( * ) Notice: Subject to any disclaimer, the term of this patent is extended or adjusted under 35 U.S.C. 154(b) by 0 days.

This patent is subject to a terminal disclaimer.

(21) Appl. No.: 09/366,750

(22) Filed: Aug. 4, 1999

Related U.S. Application Data

(63) Continuation-in-part of application No. 08/874,095, filed on Jun. 12, 1997, now Pat. No. 6,067,881, which is a continuation-in-part of application No. 08/745,473, filed on Nov. 12, 1996, now abandoned, which is a continuation of application No. 08/476,204, filed on Jun. 7, 1995, now abandoned.

(51) Int. Cl.[7] ..... B25B 13/00
(52) U.S. Cl. ..... 81/59.1; 81/60; 192/44
(58) Field of Search ..... 81/59.1, 60–63.2, 81/177.85; 192/44, 45

(56) References Cited

U.S. PATENT DOCUMENTS

| | | | | |
|---|---|---|---|---|
| 2,919,000 | * | 12/1959 | Claytor | 192/44 |
| 3,532,013 | | 10/1970 | Haznar . | |
| 3,762,245 | | 10/1973 | Smyers et al. . | |
| 3,895,701 | | 7/1975 | Albertson et al. . | |
| 4,051,935 | | 10/1977 | Nakayama . | |
| 4,099,430 | | 7/1978 | Stodola . | |
| 4,317,392 | | 3/1982 | Stephens et al. . | |
| 4,434,878 | * | 3/1984 | Olubo | 192/44 |
| 4,669,339 | | 6/1987 | Cartwright . | |
| 4,762,033 | | 8/1988 | Chow . | |
| 5,086,673 | | 2/1992 | Korty . | |
| 5,386,747 | | 2/1995 | Grover . | |
| 5,425,291 | | 6/1995 | Chang . | |
| 5,499,559 | | 3/1996 | Lin . | |
| 5,697,267 | | 12/1997 | Tsai . | |

* cited by examiner

*Primary Examiner*—James G. Smith

(57) ABSTRACT

A hand tool for turning sockets connectable to nuts and bolts has a handle attached to a head having an inside cylindrical surface. A body joined to a member for holding a socket has a plurality of pockets facing the cylindrical surface and chord ramps at the bottom of the pockets. The middle portions of each ramp has at least one axial groove to accommodate a roller to prevent inadvertent shifting of the roller to a reverse drive position. Rollers located in the pockets engage the ramps and cylindrical surface to selectively lock and unlock the head to the body so that when the handle is oscillated the body intermittently rotates. A ring mounted on the body is manually moved to shift the rollers between opposite end sections of the pockets. A socket release ball mounted on the member is controlled by a stem movably mounted on the body and member.

31 Claims, 12 Drawing Sheets

HAND TOOL

CROSS REFERENCE TO RELATED APPLICATIONS

This application is a continuation-in-part of U.S. application Ser. No. 08/874,095 filed Jun. 12, 1997 now U.S. Pat. No. 6,067,881. application Ser. No. 08/874,095 is a continuation-in-part of U.S. application Ser. No. 08/745,473 filed Nov. 12, 1996 now abandoned. Application Ser. No. 08/745,473 is a continuation of U.S. application Ser. No. 08/476,204 filed Jun. 7, 1995, now abandoned.

FIELD OF THE INVENTION

The invention relates to hand tools, particularly to a hand socket wrench having a reversible one way drive mechanism that permits infinitely variable reciprocal movement of the wrench handle to selectively drive a socket holding drive member in opposite directions. A quick release mechanism holds the socket on the drive member.

BACKGROUND OF THE INVENTION

Conventional socket wrenches have reversible one way drives that includes a ring of internal ratchet teeth and movable pawls engageable with the ratchet teeth to complete the drive couple between the handle and socket driven member. The handle must be angularly moved a minimum distance to change the interengaging positions of the ratchet teeth and pawls. This limits the use of the wrenches to environments that have sufficient space to allow for the required angular movement of the wrench handle to effect rotation of the socket driven member. These ratchet wrenches are not useable in confined spaces containing nuts and bolts that must be turned on and off threaded members.

SUMMARY OF THE INVENTION

The invention is directed to a hand tool having a reversible one way drive mechanism operable with infinitely variable strokes of a handle to convert reciprocating arcuate movement to stepped rotational movement of a drive member holding a socket. A releasable ball retains a socket or other devices on the drive member. The tool has a handle joined to a head having an inside cylindrical surface. A body having a plurality of ramps is located within the head. Each ramp has an axially extended groove or notch in its middle section to eliminate inadvertent shifting or reverse drive of the drive member. Rollers cooperate with ramps and the inside cylindrical surface of the head to drivably couple the head to the body for one way rotation of the body in response to reciprocating arcuate movement of the handle. The amount of arcuate movement of the handle can be infinitely varied or changed so that the tool can be used in confined spaces to turn nuts and bolts. The tool is efficient and effective in small spaces as it does not have backlash or play in its roller drive mechanism.

One embodiment of the hand tool is a socket wrench having an elongated handle having an end joined to a head. The head has an inside smooth cylindrical surface. A body having a plurality of pockets open to the inside surface and separate outside arcuate surfaces are located within the head. The outside arcuate surfaces are located in sliding engagement with the inside cylindrical surface of the head to allow relative rotation between the head and body and prevent lateral and wobble movements of the body relative to the head. A socket holding drive member is secured to the body. A roller comprising a rod member is positioned in each pocket. The body has a ramp or bottom wall at the bottom of each pocket. The ramps extend along chord lines so that the pockets decrease in depth from opposite sides of the centers of the pockets. The center of each ramp has an axially extended groove or notch that accommodates a portion of the roller and prevents the roller from shifting beyond the center of the ramp. Inadvertent shifting of the roller to the opposite drive position is prevented. The rollers have diameters greater than the opposite end sections of the pockets but less than the depth of the center sections of the pockets. When the rollers are shifted to either opposite end sections of the pockets, the handle is in driving relation with the body so that angular movement of the handle in one direction will drive the body and driven member. Angular movement of the handle in the opposite direction will release the drive or lock positions of the rollers allowing the handle to be moved back to a position for another power stroke. A roller shifting ring and washer are rotatably mounted on the head adjacent opposite sides of the body. The ring and washer have annular surfaces that ride on cooperating surfaces on the head to stabilize the body and retain the concentric relationship of the body with the head. The ring is attached to members extended into the pockets for controlling the shifting of the rollers in the pockets. A plurality of detents between the body and ring allow the ring to be selectively angularly moved between first and second positions to locate the rollers in opposite end sections of the pockets. This allows oscillation of the handle to drive the socket holding member in opposite directions determined by the position of the ring relative to the body. The detents releasably hold the ring in its selected first or second positions. A socket release mechanism releasably retains a socket on the drive member. The socket release mechanism has a ball retained in the driven member and controlled with a movable stem mounted on the body.

Another embodiment of the hand tool has an elongated handle with an end joined to a head. The head has an inside smooth cylindrical surface. A body having a plurality of pockets open to the inside surface and separate outside arcuate surfaces are located within the head. The outside arcuate surfaces are located in sliding engagement with the inside cylindrical surface of the head to allow relative rotation between the head and body and prevent lateral and wobble movements of the body relative to the head. A socket holding member is secured to the body. A roller comprising a rod member is positioned in each pocket. The body has ramps or bottom walls at the bottom of each pocket. The ramps extend along chord lines so that the pockets decrease in depth from opposite sides of the centers of the pockets. The middle portion of each ramp has an axially extended groove or notch that accommodates a portion of the roller and prevents the roller from shifting past the groove. When the roller is in the groove the outer surface of the roller disengages the inside cylindrical surface of the head thereby relieving the wedge forces acting on the roller. The rollers have diameters greater than the opposite end sections of the centers of the pockets. The rollers have diameters greater than the opposite end sections of the pockets but less than the depth of the center sections of the pockets. The upper ends of the rollers extend into radial slots in a ring mounted on the head. When the rollers are shifted to either opposite end sections of the pockets, the handle is in driving relation with the body so that angular movement of the handle in one direction will drive the body and driven member. Angular movement of the handle in the opposite direction will release the drive or lock positions of the rollers allowing the handle to be moved back to a position for another power stroke. The roller shifting ring and washer are rotatably mounted on the head adjacent opposite sides of the body. The ring and washer have annular surfaces that ride on cooperating surfaces on the head to stabilize the body and retain the concentric relationship of the body with the head. The ring controls the shifting of the rollers in the pockets as the upper ends of the rollers extend into slots in the ring. A plurality of detents between the body and ring allow the ring to be selectively angularly moved between first and second positions to locate the rollers in opposite end sections of the pockets. This allows oscillation of the handle to drive the socket holding member in opposite directions determined by the position of the ring relative to the body. The detents releasably hold the ring in its selected first or second positions. A socket release mechanism releasably retains a socket on the drive member. The socket release mechanism has a ball retained in the driven member and controlled with a movable stem mounted on the body.

A further embodiment of the hand tool has a handle joined to a head having a smooth internal cylindrical surface. A body having ramps is rotatably located within the head concentric with the cylindrical surface. The body has a hexagonal shape with six ramps. Each ramp has an axial groove or notch providing a recess for the roller to prevent the roller from shifting to a reverse drive position. The groove located generally in the middle of the ramp extends parallel to the axix of rotation of the body. Each ramp can have more than one axial groove. The body can have other body shapes having ramps extended along chord planes of the cylindrical surface. Cylindrical rollers are disposed between the ramps and cylindrical surface. A roller shifting ring and washer mounted on the head on opposite sides of the body hold the body and washer in assembled relation with each other. The ring and washer have annular surfaces that ride on cooperating surfaces on the head to stabilize the body and retain the concentric relationship of the body with the head. The roller shifting ring has arcuate segments that extend between adjacent rollers. Each segment has an outer arcuate surface that rides on the cylindrical surface of the head and an inner surface. The corners of the body ride on the inner surfaces of the segments to further maintain the central location of the body within the head. A plurality of detents between the body and ring allow the ring to be selectively angularly moved between first and second positions to locate the rollers adjacent opposite ends of the ramps. A socket release mechanism mounted on the body releasably retains a socket on a drive member joined to the head.

DESCRIPTION OF THE PREFERRED EMBODIMENTS

Figure 1:
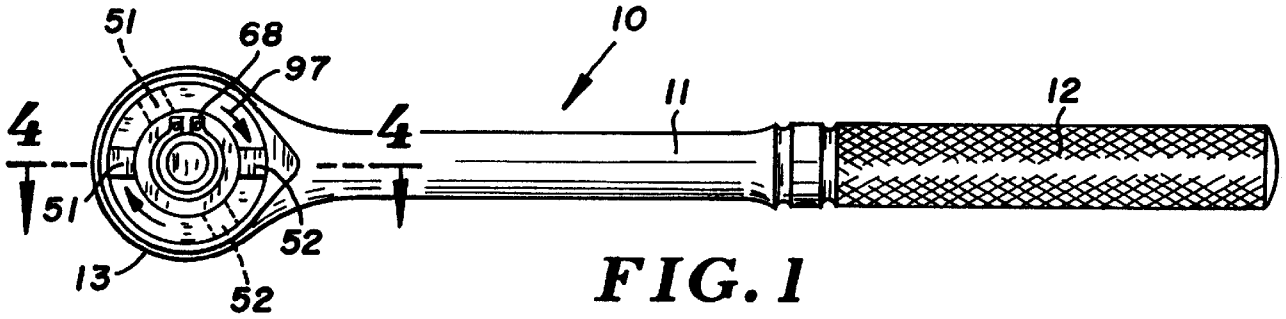
FIG. 1 is a top plan view of the hand tool of the invention.
Figure 2:
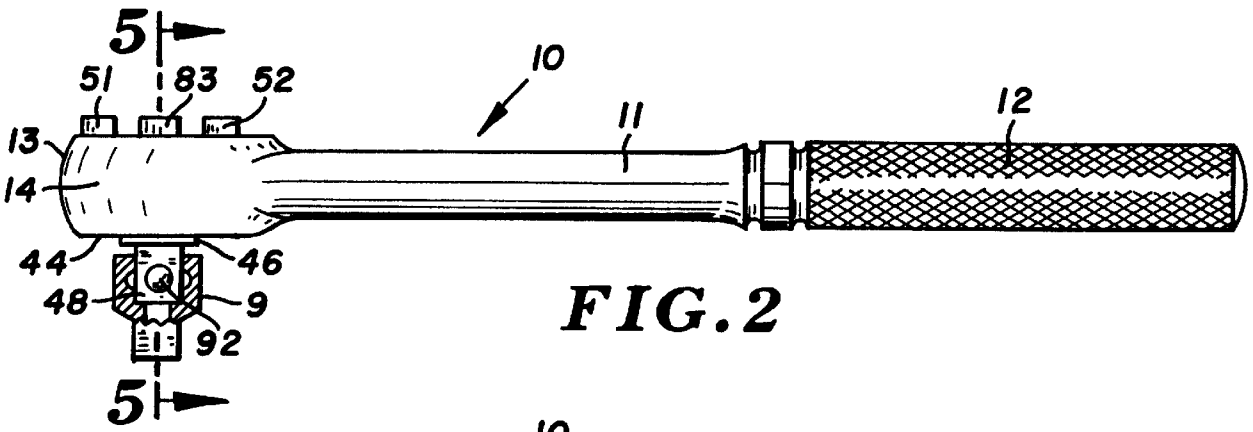
FIG. 2 is a side elevational view thereof.
Figure 3:
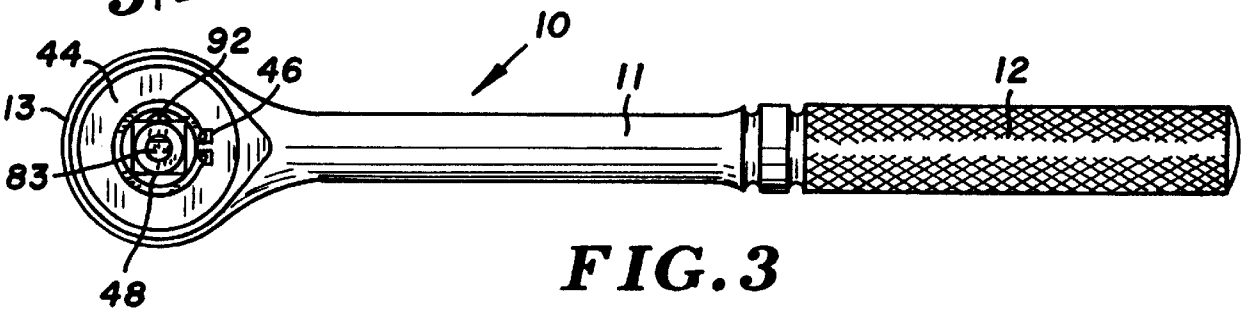
FIG. 3 is a bottom plan view thereof.
Figure 4:
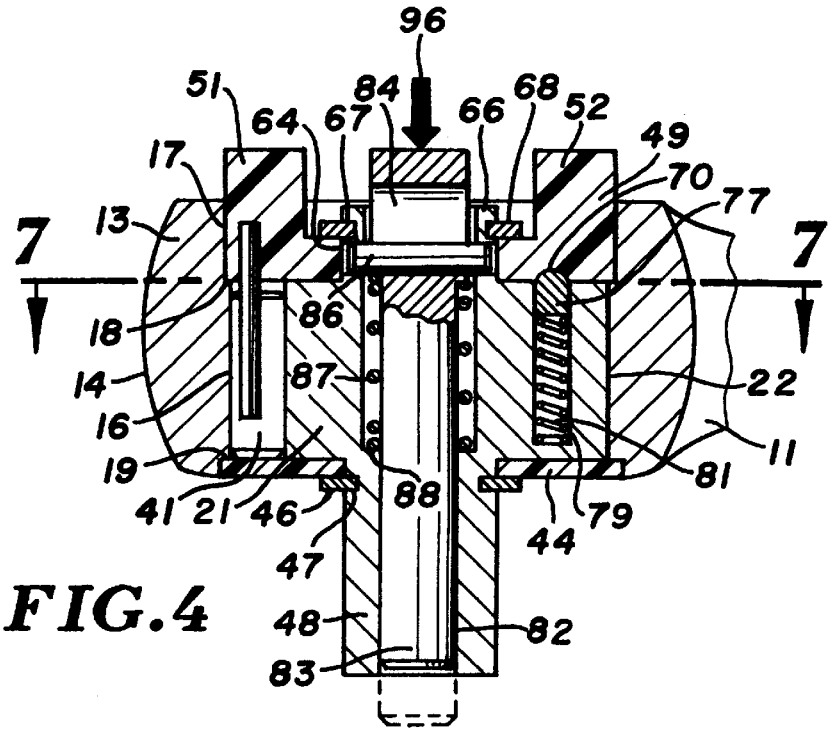
FIG. 4 is an enlarged sectional view taken along the line 4—4 of FIG. 1.

Hand tool 10, shown in FIGS. 1 to 3, is known as a reversible socket wrench for holding a tubular socket 9 used to turn threaded nuts and bolts which may be located in confined spaces. Other devices, such as blades, cross drivers, taps, drills and reamers can be turned with tool 10 with the use of structures coupling the devices to the drive member 48 of the tool. Tool 10 has an elongated tubular handle 11 with a hand grip outer surface at the outer end thereof. A cylindrical head 13 is joined to the inner end of handle 11. Head 13 has a convex outer surface 14 and an inner or inside cylindrical first surface 16 and an inside cylindrical second surface 17. Surfaces 16 and 17 are concentric with the transverse center line or vertical axis of head 13. The diameter of surface 17 is larger than the diameter of surface 16. An annular shoulder 18 is located between surfaces 16 and 17. As seen in FIG. 4, the bottom of head 13 has an annular recess forming a second annular shoulder 19 accommodating the outer edge of a washer 44.

Figure 7:
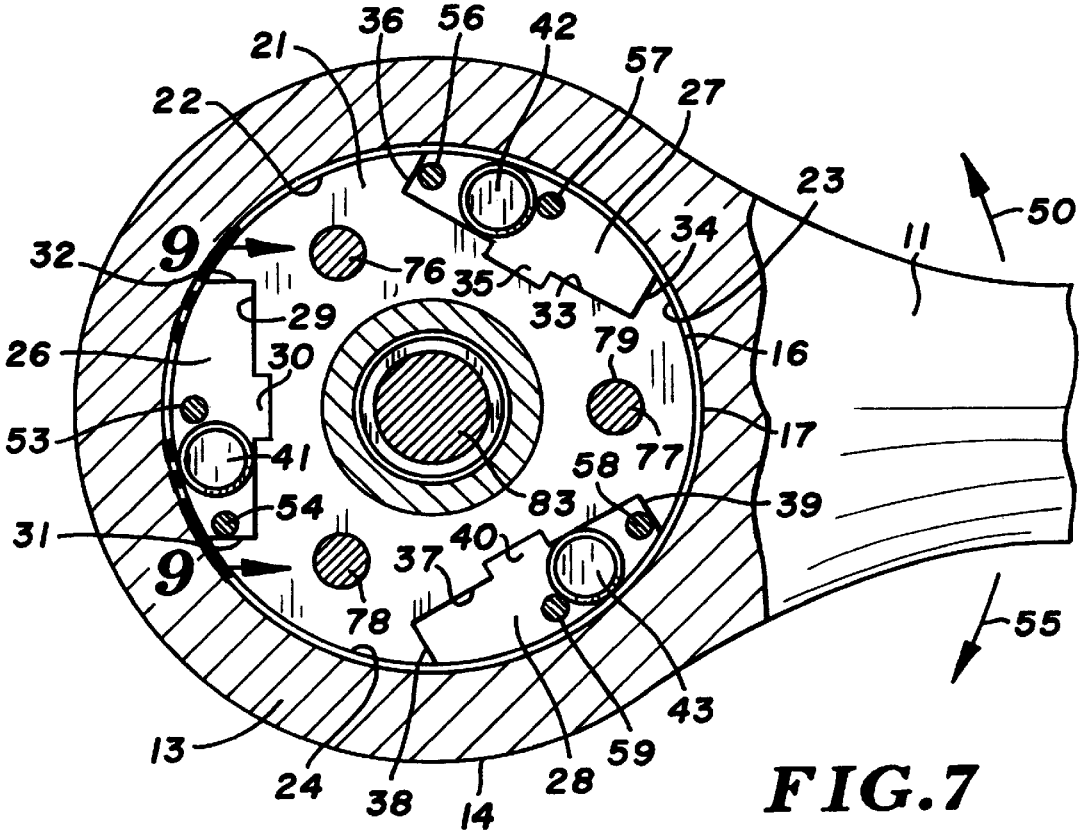
FIG. 7 is an enlarged sectional view taken along the line 7—7 of FIG. 4 showing the lock position of the rollers for counterclockwise driving of the tool.
Figure 8:
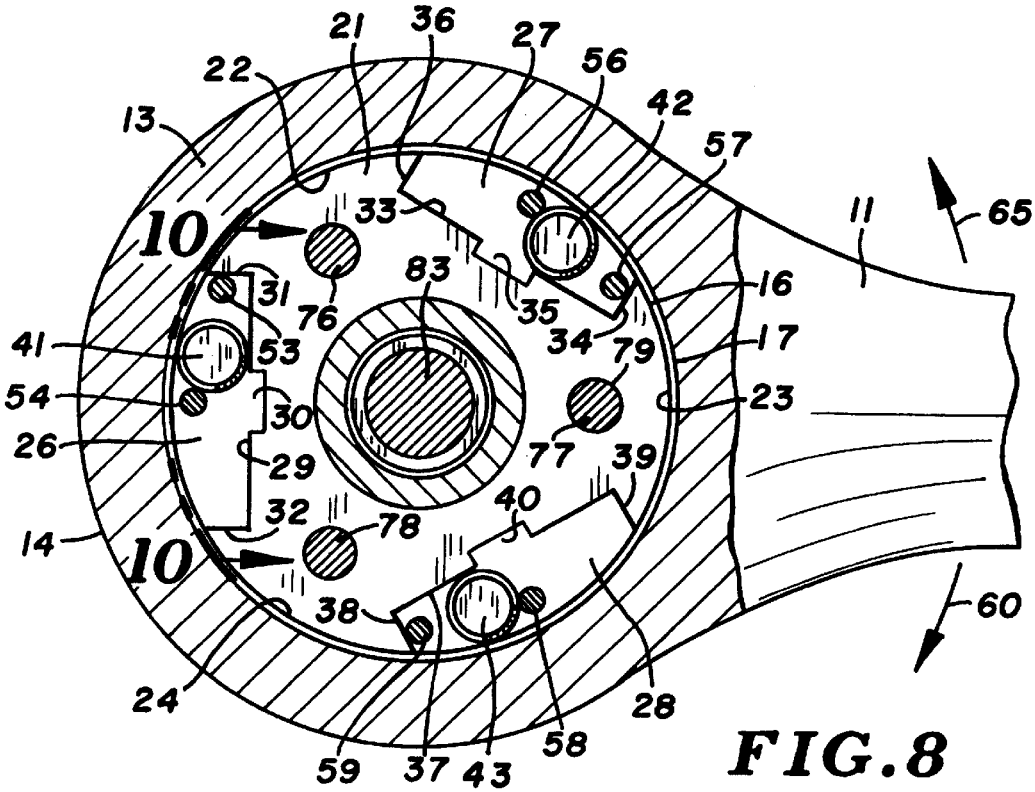
FIG. 8 is a sectional view similar to FIG. 7 showing the lock position of the rollers for clockwise driving of the tool.

As seen in FIGS. 7 and 8, a rotatable body 21 located within head 13 has three outer arcuate surface segments 22, 23 and 24 located in sliding surface engagement with inside cylindrical surface 16 of head 13. Segments 22, 23 and 24 slide on surface 16 to allow body 21 to rotate relative to head 13 about the vertical axis of head 13 and prevent lateral movement or wobble of body 21 on head 13. Body 21 has three identical pockets 26, 27 and 28 open to surface 16. Pockets 26, 27 and 28 are circumferentially spaced about 120 degrees relative to each other around body 21. Each pocket 26–28 has an arcuate length of about 60 degrees. Pockets 26, 27 and 28 extend the entire width or thickness of body 21 to facilitate machining of body 21. Body 21 has three bottom walls or ramps 29, 33 and 37 at the bottom of pockets 26, 27 and 28. Ramps 29, 33 and 37 are linear flat walls extended along chord lines located inwardly of the outer circumference of body 21. Each ramp 29, 33 and 37 has a center that is perpendicular to a radius of body 21. As shown in FIGS. 7 and 8, the centers of ramps 29, 33 and 37 have generally U-shaped grooves or notches 30, 35 and 40. Each groove 30, 35 and 40 extends parallel to the axis of rotation of body 21 and axis of rotation of the rollers 41, 42 and 43. The width of each groove is about one-half the diameter of a roller. The depth of each groove is 1/32 inch. Grooves having other widths and depths can be placed in the ramps to accommodate the rollers. The grooves 30, 35 and 40 prevent the rollers 41, 42 and 43 from inadvertently shifting beyond the centers of the ramps 29, 33 and 37. When rollers 41, 42 and 43 are in grooves 30, 35 and 40 the outer surfaces of the rollers disengage the inside cylindrical surface of the head thereby relieving the wedge forces acting on rollers 41, 42 and 43. Ramps 29, 33 and 37 can have additional axial grooves for accommodating rollers 41, 42 and 43. Pocket 26 has opposite end walls 31 and 32 extended from opposite ends of ramp 29 to the circumference of body 21. Second pocket 27 has opposite end walls 34 and 36 extended from opposite ends of ramp 33 to the circumference of body 21. Third pocket 28 has end walls 38 and 39 extended from opposite ends of ramp 37 to the circumference of body 21. Each pocket 26, 27 and 28 has a maximum radial depth at the center of the pocket and progressively decreases in depth in opposite directions from the maximum radial depth.

Rollers or cylindrical rod members 41, 42 and 43 have lengths that are substantially the thickness of body 21 and diameters smaller than the maximum radial depth of pockets 26, 27 and 28. When rollers 41, 42 and 43 are moved toward the centers of pockets 26, 27 and 28, they fall into grooves 30, 35 and 40 allowing body 21 to rotate relative to head 13.

Figure 5:
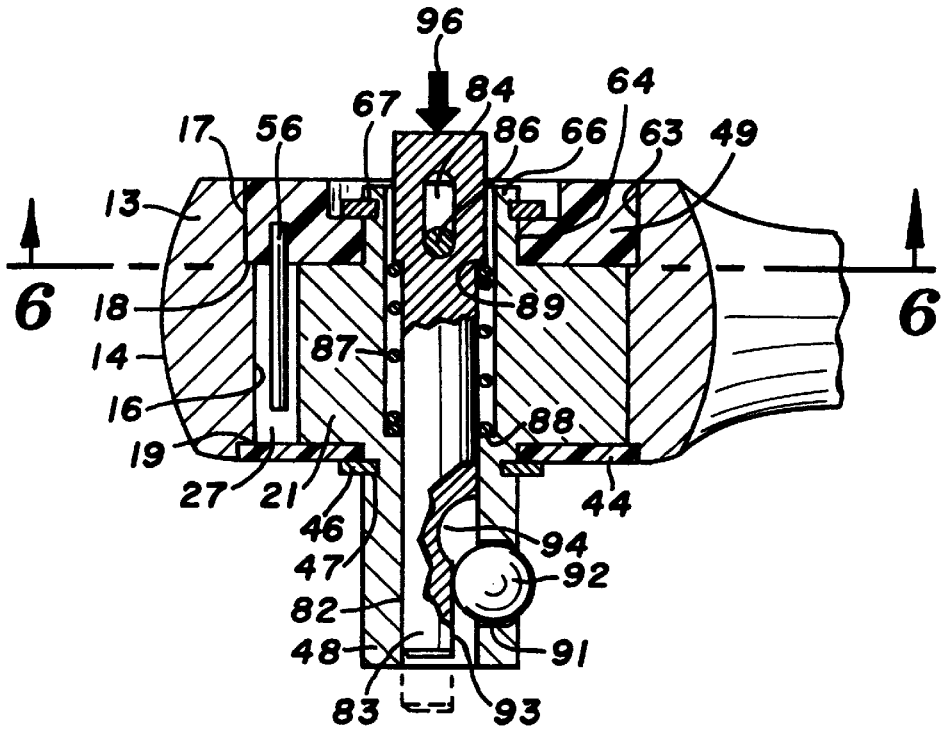
FIG. 5 is a sectional view taken along the line 5—5 of FIG. 2.
Figure 6:
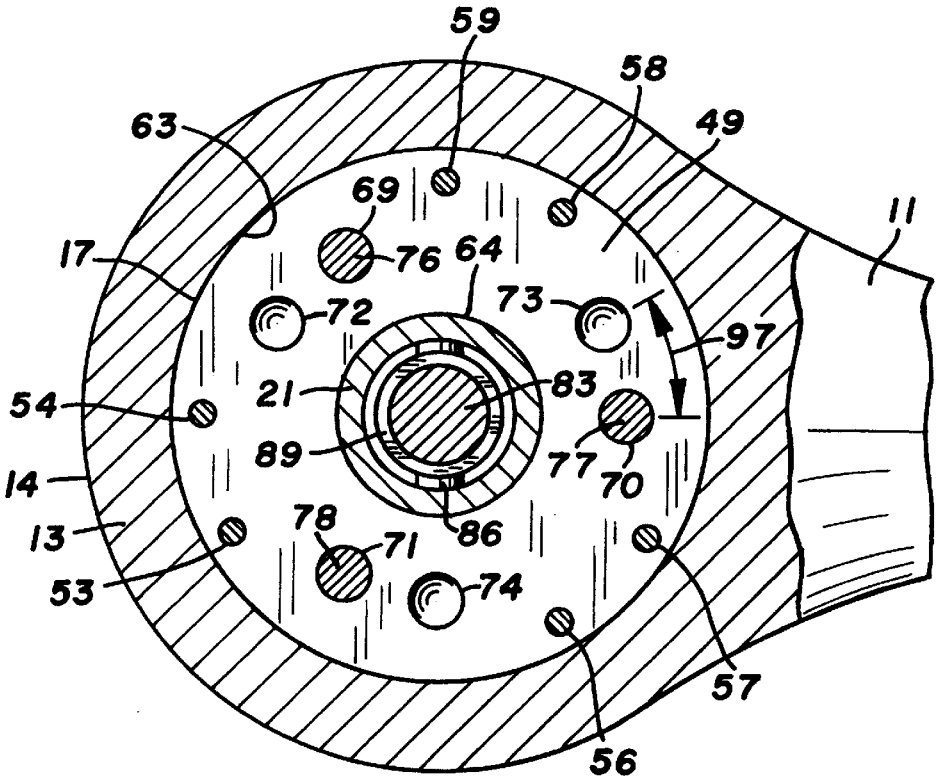
FIG. 6 is a sectional view taken along the line 6—6 of FIG. 5.

As shown in FIGS. 4 and 5, the bottoms of pockets 26, 27 and 28 are closed with a washer or flat ring 44. A releasable retainer 46, shown as a snap ring, fits into an annular groove 47 in a drive member or stem 48 extended downwardly from body 21. Stem 48 and body 21 are a single piece of metal. Stem 48 has a square cross section to accommodate the square cross section of recess of socket 9.

Figure 9:
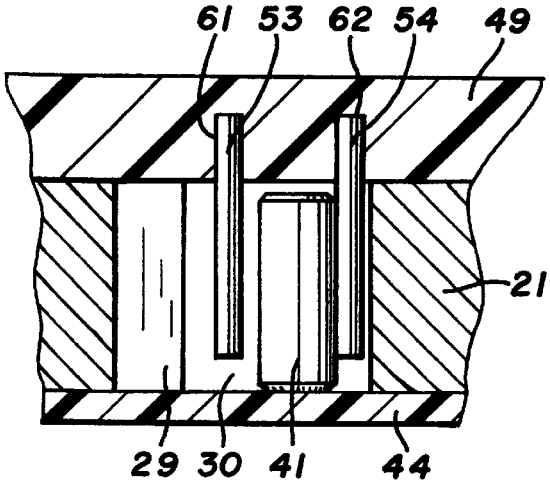
FIG. 9 is a sectional view taken along the line 9—9 of FIG. 7.
Figure 10:
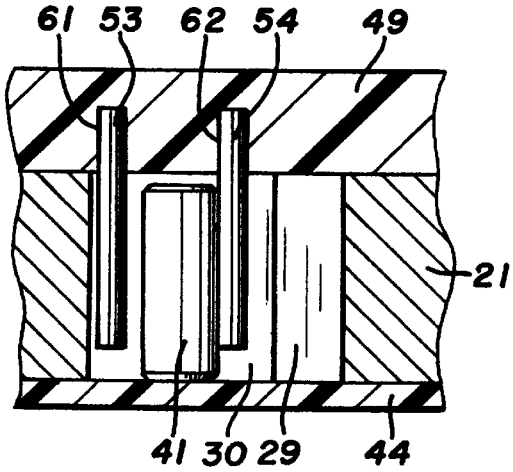
FIG. 10 is a sectional view taken along the curved section line 10—10 of FIG. 8.
Figure 11:
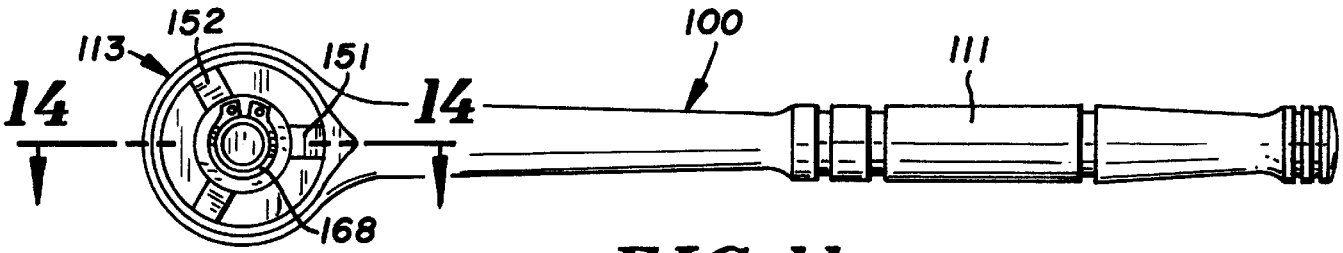
FIG. 11 is a top plan view of a first modification of the hand tool of the invention.
Figure 12:
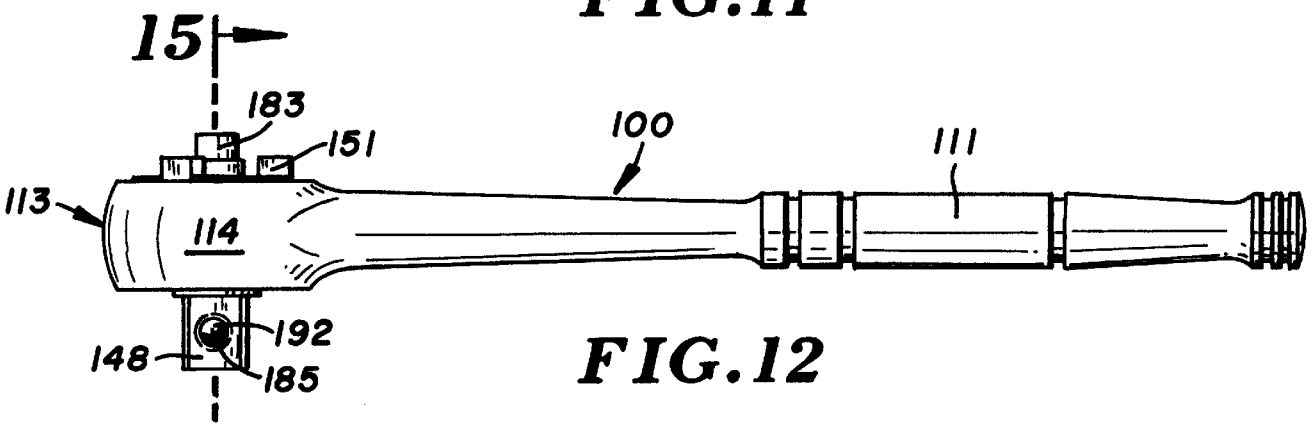
FIG. 12 is a side elevational view of FIG. 11.

An annular ring 49 is located in head 13 above body 21. Upwardly projected tabs or ears 51 and 52 joined to ring 49 are finger grips used by a person to angularly change the position of ring 49 between a clockwise drive and a counterclockwise drive as hereinafter described. Three pairs of roller control rods 53 and 54, 56 and 57, and 58 and 59 connected to ring 49 extend into pockets 26, 27 and 28. Returning to FIGS. 7 and 8, rods 53 and 54 are positioned on opposite sides of roller 41, rods 56 and 57 are positioned on opposite sides of roller 42, and rods 58 and 59 are positioned on opposite sides of roller 43. The circumferential distance between adjacent rods is greater than the diameter of the roller to allow the roller to have limited circumferential movement between its lock and unlock positions. Rollers 41, 42 and 43 are free to rotate about their axes thereby distribute wear and locking forces around the surfaces of the rollers. As shown in FIGS. 9 and 10, rods 53 and 54 extend into bores 61 and 62 in ring 49. When ring 49 is rotated, the pairs of rods 53 and 54 extend into bores 61 and 62 in ring 49. When ring 49 is rotated, the pairs of rods 53 and 54, 56 and 57, and 58 and 59 move rollers 41, 42 and 43 in pockets 26, 27 and 28. Counterclockwise rotation of ring 49 locates rollers 41, 42 and 43 in the ends of pockets 26, 27 and 28 adjacent walls 31, 36 and 39 as shown in FIG. 7. When handle 11 is moved in the counterclockwise direction, as shown by arrow 50 in FIG. 7, body 21 is driven by the turning head 13 because rollers 41, 42 and 43 are wedged between ramps 29, 33 and 37 and head inside wall 16. Moving handle 11 in the opposite direction, shown by arrow 55, unlocks rollers 41, 42 and 43 from the drive positions shown in FIG. 7 and allows handle 11 to be moved without driving body 21. Handle 11 can be arcuately moved or oscillated in opposite directions to rotate body 21 and drive member 48 in one direction. Rollers 41, 42 and 43 are free to lock on any portions of cylindrical surface 16 to provide the person with a precise feel and performance in tight or close spaces. Rollers 41, 42 and 43 eliminate backlash found in conventional pawl and ratchet teeth drives.

Clockwise rotation of ring 49 moves rollers 41, 42 and 43 adjacent end walls 31, 34 and 38 and in driving engagement with ramps 29, 33 and 37 and inside wall 23. Clockwise movement of handle 11, shown by arrow 60 in FIG. 8, causes rollers 41, 42 and 43 to wedge between ramps 29, 33 and 37 and inside wall 16 of head 13 thereby turning body 21 with handle 11. Moving handle 11 in the opposite direction, shown by arrow 65, unlocks rollers 41, 42 and 43 from their drive positions and allows handle 11 to be moved without driving body 21. Reciprocating or stroking handle 11 in opposite directions will cause body 21 to be driven in one direction according to the position of rollers 41, 42 and 43 as determined by the angular location of ring 49.

Ring 49 has an outer cylindrical surface 63 located in sliding rotational engagement with the inside cylindrical surface 17 of head 13. The bottom outer edge of ring 49 rides on shoulder 18. The center of ring 49 has a hole 64 for an upright boss 66 joined to body 21. Boss 66 has an annular groove accommodating a snap ring 68 that holds ring 49 on body 21 and allows ring 49 to be rotated relative to body 21 to change the locations of rollers 41, 42 and 43 in pockets 26, 27 and 28. Washer 44 and ring 49 retain body 21 in assembled relation on head 13.

The position of ring 49 relative to body 21 is controlled with releasable holders, shown as spring biased detents, having three pairs of recesses 69, 72 and 70, 73 and 71,74 and plungers 76, 77 and 78 that selectively fit into one of each pair of recesses. As shown in FIG. 4, plunger 77 is located in a blind bore 79 and biased up into recess 70 with a coil spring 81. The upper end of plunger 77 has a semi-hemispherical shape so that on rotation of ring 49 plunger 77 will release from recess 70 and move into recess 73. Plungers 76 and 78 have the same structure as plunger 77 and are located in blind bores accommodating biasing springs. Plungers 76, 77 and 78 releasably retain ring 49 in either a first position or a second position to selectively locate rollers 41, 42 and 43 in clockwise and counterclockwise lock positions.

Returning to FIGS. 4 and 5, body 21, stem 48 and boss 66 have an upright bore 82 with an internal shoulder 88. A stem 83 having an upright slot 84 in the upper end thereof is located within bore 82. A transverse pin 86 extended through slot 84 anchored on boss 66, as shown in FIG. 4, limits vertical movement of stem 83. Coil spring 87 located in bore 82 abuts against shoulder 88 and a shoulder 89 on stem 83 biases stem 83 upward to a socket lock position. The drive member 48 has a tapered side hole 91 accommodating a ball 92. The inside curved part of ball 92 fits into one of two recesses 93 and 94 in stem 83. When stem 83 is in its up or lock position, ball 92 is located in recess 93. The outer part of ball 92 extends laterally from drive member 48. Ball 92 cooperates with an internal recess in a socket to hold the socket on drive member 48. When stem 83 is pushed down, as indicated by arrow 96 in FIG. 4, recess 94 is aligned with ball 92 so that ball 92 is free to move into drive member 48. The socket 9 can be removed from drive member 48 since ball 92 does not hold socket 9 on drive member 48. When the force on stem 83 has been removed, spring 87 biases stem 83 upwardly thereby moving ball to the out lock position.

In use stem 83 is moved down to allow socket 9 or other devices for turning a nut or bolt head to be placed on drive member 48. When the force on stem 83 has been removed, stem 83 is moved up by spring 87 causing ball 92 to move out to lock socket 9 on drive member 48. The clockwise or counterclockwise directions of the drive of member 48 are determined by the angular position of ring 49 which controls the locations of rollers 41, 42 and 43 in pockets 26, 27 and 28. As shown in FIG. 7, when rollers 41, 42 and 43 are in the left end of pockets 26, 27 and 28, the drive rotation of handle 11 and body 21 is counterclockwise. This will release a right hand threaded nut from its associated bolt or stud. As shown in FIG. 8, when rollers 41, 42 and 43 are in the right end of pockets 26, 27 and 28, the drive rotation of handle 11 and body 21 is clockwise. This will tighten a right hand threaded nut on to its associated bolt or stud. Handle 11 can be moved in the opposite direction without turning body 21 and the socket on member 48 because rollers 41, 42 and 43 are released from driving engagement with ramps 29, 33 and 37 and inside surface 23 of head 13. The amount of reciprocating arcuate movement of handle 11 can vary as rollers 41, 42 and 43 can lock in engagement with any circumferential portions of inside surface 23 of head 13. The operation of tool 10 is infinitely variable as there are no ratchet teeth and pawls in the drive mechanism that control the amount of reciprocating arcuate movement of the handle of the tool. Tool 10 is useable in small and tight spaces since small amounts of movement of handle 11 will drive body 21 and drive member 48 to turn a nut or bolt in selected opposite directions.

Figure 13:
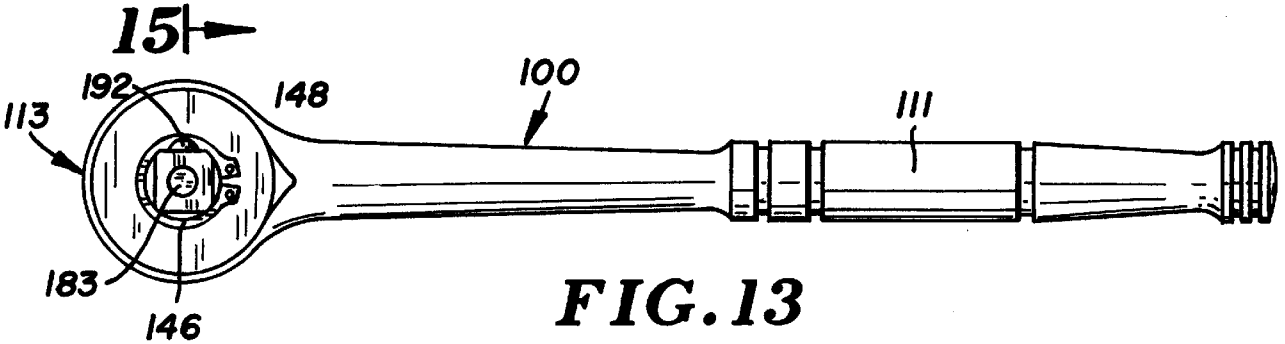
FIG. 13 is a bottom plan view of FIG. 11.
Figure 14:
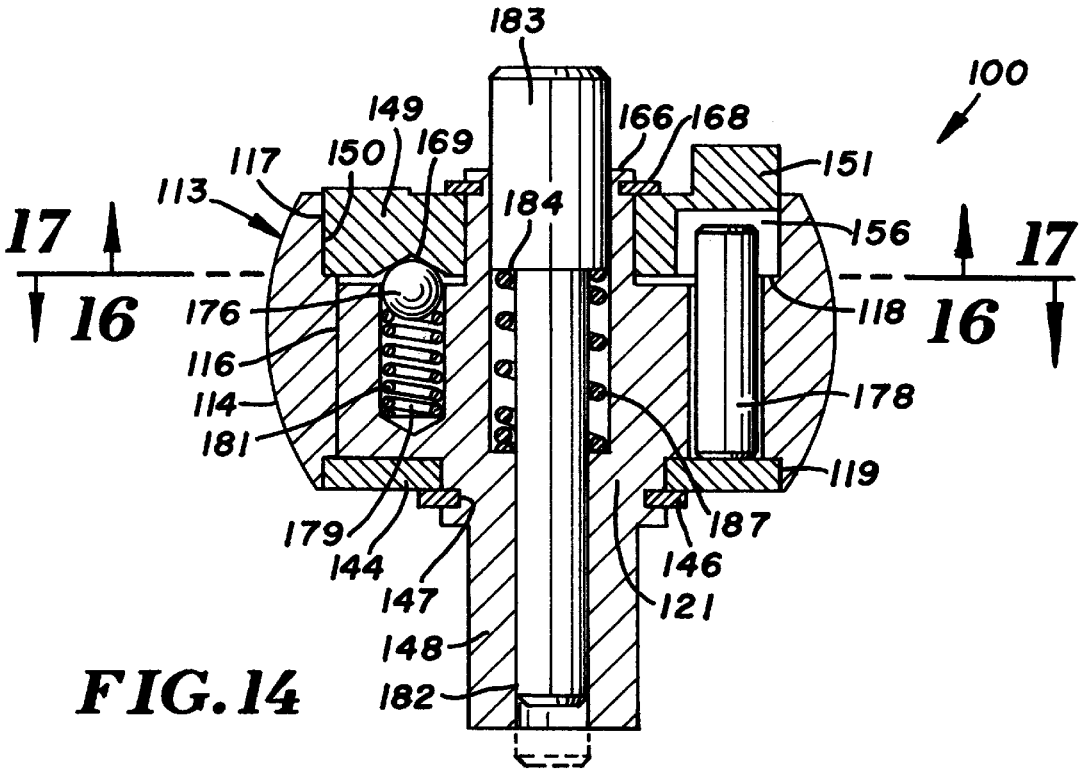
FIG. 14 is an enlarged sectional view taken along the line 14—14 of FIG. 11.

A first embodiment of the hand tool, indicated generally at 100, is shown in FIGS. 11 to 20. Tool 100 has an elongated generally cylindrical handle 111 with a hand grip outer surface at the outer end thereof. A cylindrical head 113 is joined to the inner end of handle 111. Head 113 has a convex outer surface 114 and an inner or inside cylindrical first surface 116 and an inside cylindrical second surface 117. Surfaces 116 and 117 are concentric with the transverse center line or vertical axis of head 113. The diameter of surface 117 is larger than the diameter of surface 116. An annular shoulder 118 is located between surfaces 116 and 117. As seen in FIG. 14, the bottom of head 113 has an annular recess forming a second annular shoulder 119 accommodating the outer edge of a washer 144 to maintain the washer concentric with the transverse axis of head 113. A split ring 146 holds washer 144 on a body 121.

Figure 17:
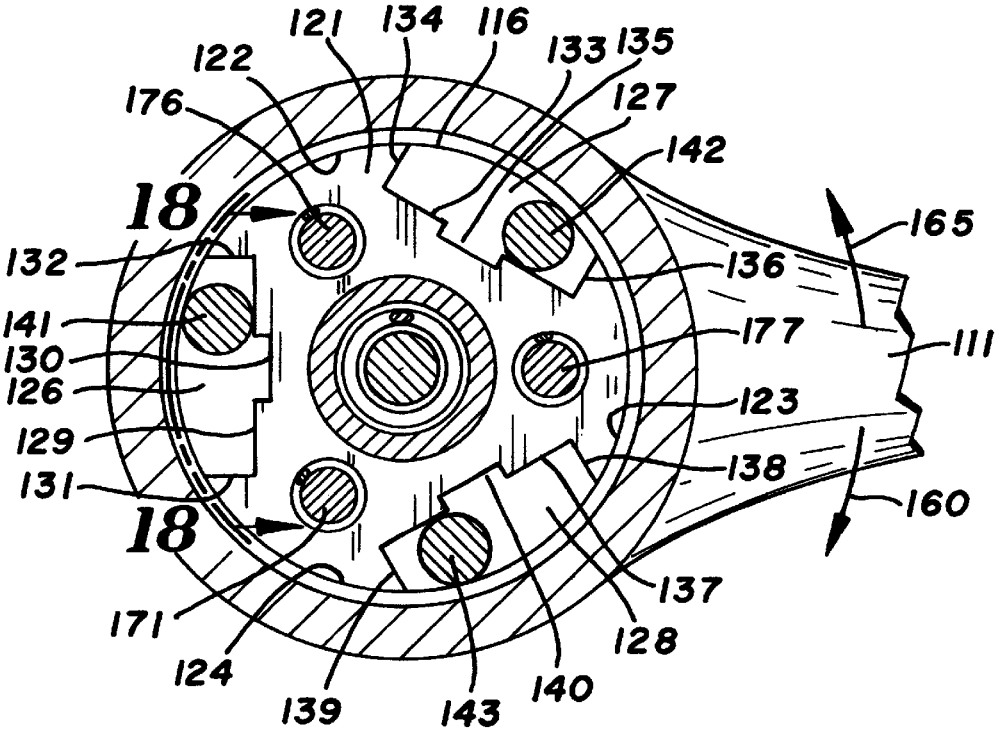
FIG. 17 is a sectional view taken along the line 17—17 of FIG. 14 showing the lock positions of the rollers for clockwise driving of the tool.
Figure 18:
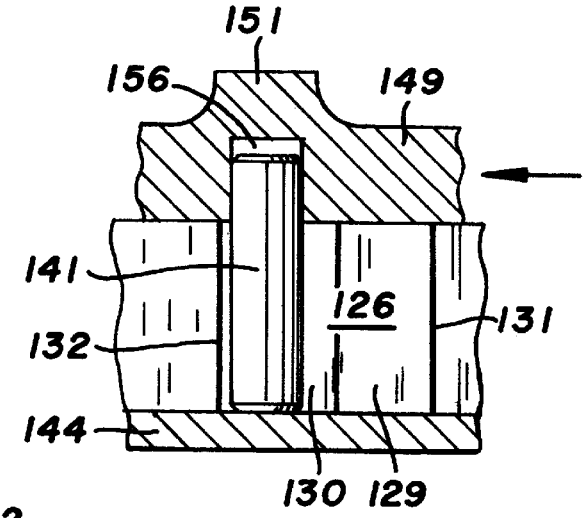
FIG. 18 is an enlarged sectional view taken along the line 18—18 of FIG. 17.
Figure 19:
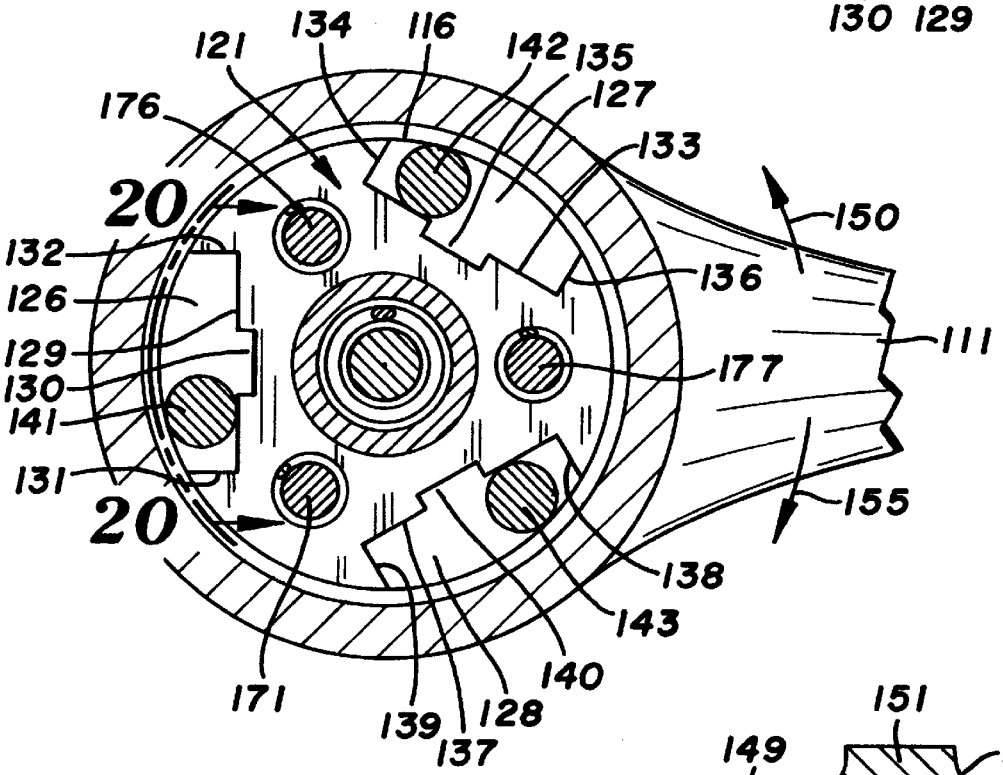
FIG. 19 is a sectional view similar to FIG. 17 showing the lock positions of the rollers for counterclockwise driving of the tool.
Figure 20:
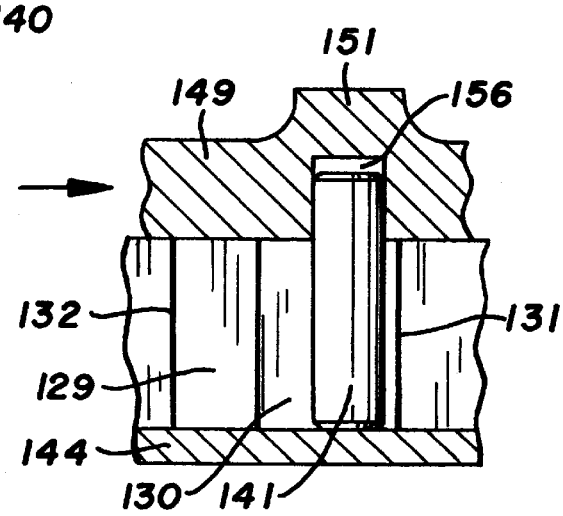
FIG. 20 is an enlarged sectional view taken along the line 20—20 of FIG. 19.
Figure 21:
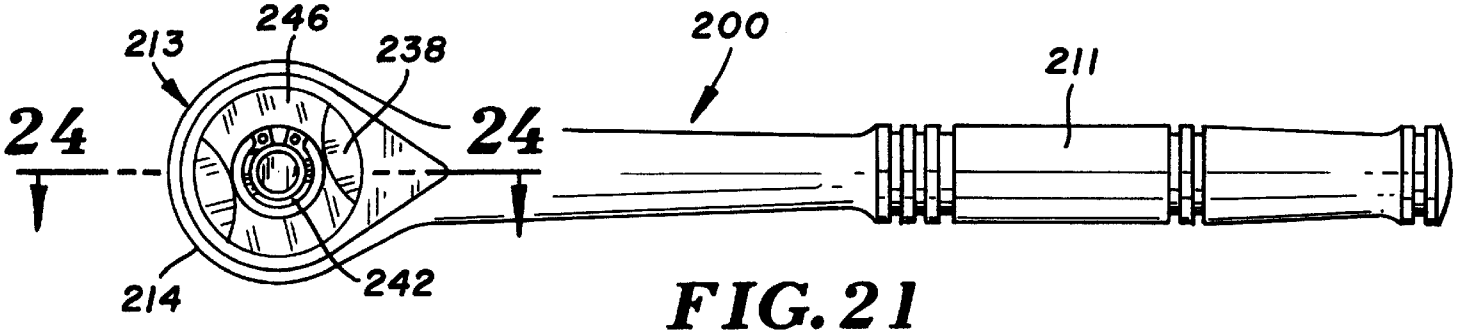
FIG. 21 is a top plan view of a second modification of the hand tool of the invention.
Figure 22:
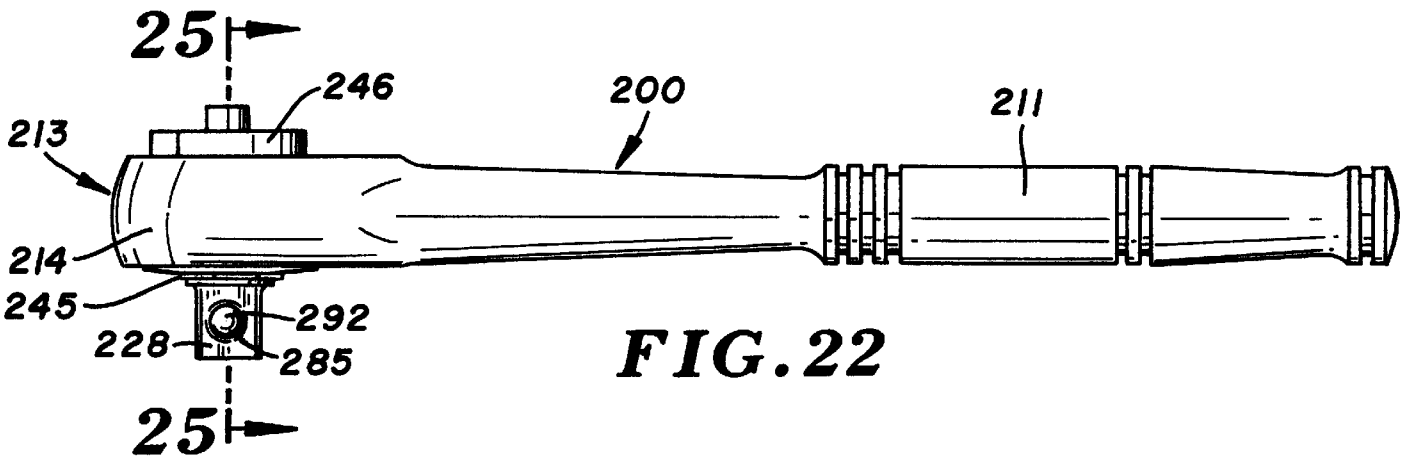
FIG. 22 is a side elevational view of FIG. 21.

As seen in FIGS. 17 and 19, rotatable body 121 located within head 113 has three outer arcuate surface segments 122, 123 and 124 located in sliding surface engagement with inside cylindrical surface 116 of head 113. Segments 122, 123 and 124 slide on surface 116 to allow body 121 to rotate relative to head 113 about the vertical axis of head 113 and prevent lateral movement or wobble of body 121 on head 113. Body 121 has three identical pockets 126, 127 and 128 open to surface 116. Pockets 126, 127 and 128 are circumferentially spaced about 120 degrees relative to each other around body 121. Each pocket has an arcuate length of about 60 degrees. Pockets 126, 127 and 128 extend the entire width or thickness of body 121 to facilitate machining of body 121. Body 121 has three bottom walls or ramps 129, 133 and 137 at the bottom of pockets 126, 127 and 128. Ramps 129, 133 and 137 are linear flat walls extended along chord lines located inwardly on the outer circumference of body 121. Each ramp 129, 133 and 137 has a center that is perpendicular to a radius of body 121. As shown in FIGS. 17 and 19, the middle portions of ramps 129, 133 and 137 have generally U-shaped grooves or notches 130, 135 and 140. Each groove 130, 135 and 140 extends parallel to the axis of rotation of body 21 and axis of rotation of the rollers 141, 142 and 143. The width of each groove is about one-half the diameter of a roller. The depth of each groove is 1/32 inch. Grooves having other widths and depths can be placed in the ramps to accommodate the rollers. The grooves 130, 135 and 140 prevent the rollers 141, 142 and 143 from inadvertently shifting beyond the centers of the ramps 129, 133 and 137. When rollers 141, 142 and 143 are in grooves 130, 135 and 140 the outer surfaces of the rollers disengages the inside cylindrical surface of the head thereby relieving the wedge forces acting on rollers 141, 142 and 143. Ramps 129, 133 and 137 can have additional axial grooves for accommodating rollers 141, 142 and 143. Pocket 126 has opposite end walls 131 and 132 extended from opposite ends of ramp 129 to the circumference of body 121. Second pocket 127 has opposite end walls 134 and 136 extended from opposite ends of ramps 133 to the circumference of body 121. Third pocket 128 has end walls 138 and 139 extend from opposite ends of ramp 137 to the circumference of body 121. Each pocket 126, 127 and 128 has a maximum radial depth at the center of the pocket and progressively decreases in depth in opposite directions from the maximum radial depth.

Rollers or cylindrical rod members 141, 142 and 143 have lengths that are greater than the thickness of body 121 and diameters smaller than the maximum radial depth of pockets 126, 127 and 128. When rollers 141, 142 and 143 are moved toward the centers of pockets 126, 127 and 128, body 121 is free to rotate relative to head 113.

Figure 15:
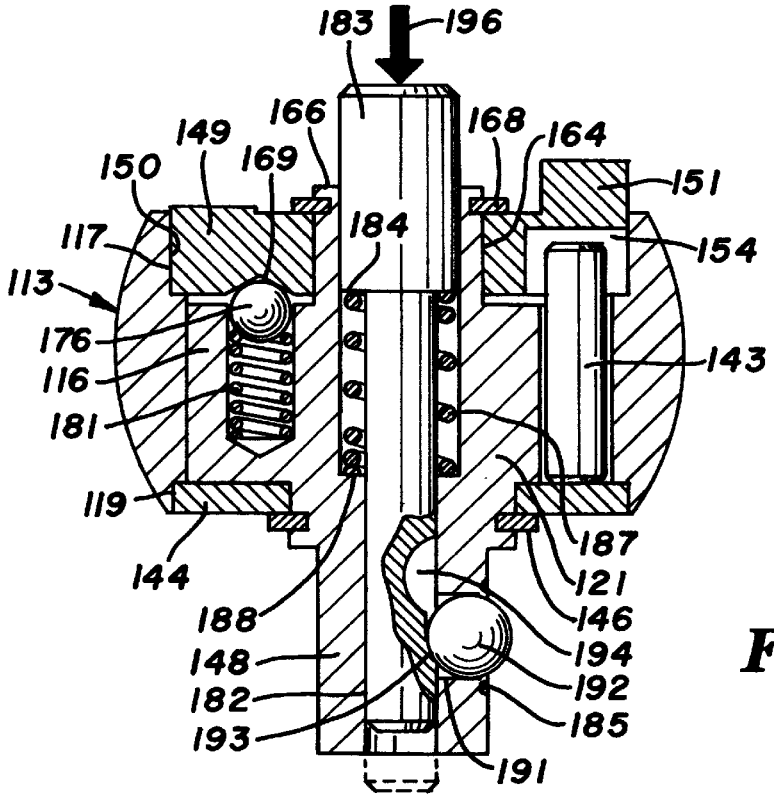
FIG. 15 is an enlarged sectional view taken along the line 15—15 of FIG. 12.

As shown in FIGS. 14 and 15, the bottoms of pockets 126, 127 and 128 are closed with a washer or flat ring 144. A releasable retainer 146, shown as a snap ring, fits into an annular groove 147 in a drive member or stem 148 extended downwardly from body 121. Stem 148 and body 121 are a single piece of metal. As shown in FIG. 13, stem 148 has a square cross section to accommodate the square cross section recess of a socket.

Figure 16:
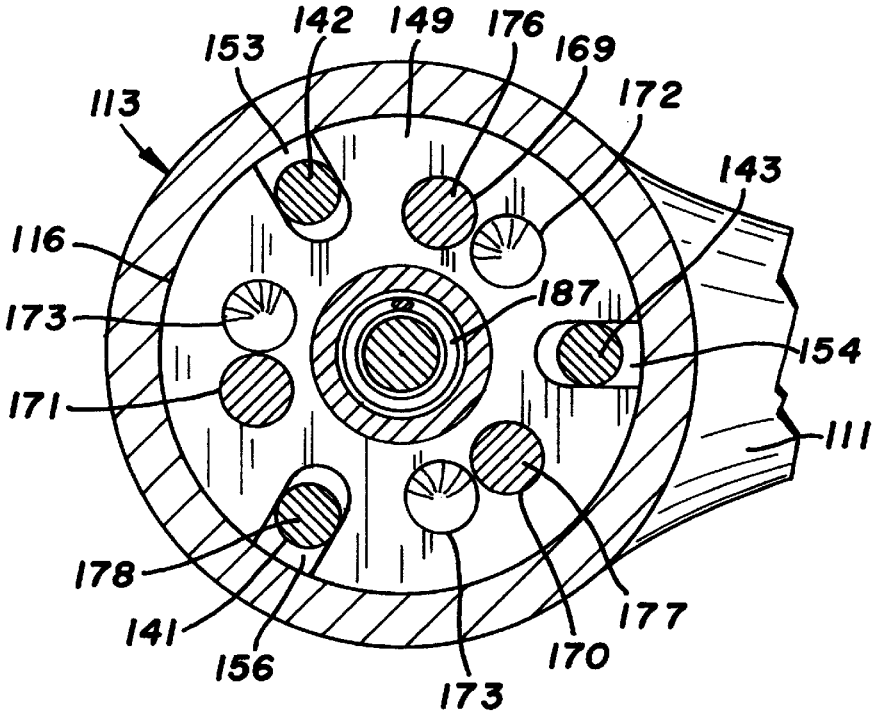
FIG. 16 is a sectional view taken along the line 16—16 of FIG. 14.

An annular ring 149 is located in head 113 above body 121. Ring 149 has an outer cylindrical surface 150 located in sliding contact with surface 117 of head 113. Ring 149 rides on surface 117 and washer 144 engaging surface 119 maintains body 121 concentric with the vertical axis of head 113. Upwardly projected tabs or ears 151 and 152 joined to ring 149 are finger grips used by a person to angularly change the position of ring 149 between a clockwise drive and a counterclockwise drive as hereinafter described. As shown in FIG. 16, ring 149 has three radially extended slots 153, 154 and 156. Each slot 153, 154 and 156 has a radial length greater than the diameter of the upper ends of rollers 141, 142 and 143 which extend into slots 153, 154 and 156. Rotation of ring 149 moves rollers 141, 142 and 143 to opposite ends of pockets 126, 127 and 128 as shown in FIGS. 17 and 19. Rollers 141, 142 and 143 are free to rotate about these axes and move radially in slots 153, 154 and 156 thereby distribute wear and even locking forces around the surfaces of rollers 141, 142 and 143.

The center of ring 149 has a hole 164 for an upright boss 166 joined to body 121. Boss 166 has an annular groove accommodating a snap ring 168 that holds ring 149 on body 121 and allows ring 149 to be rotated relative to body 121 to change the locations of rollers 141, 142 and 143 in pockets 126, 127 and 128. Washer 144 and ring 149 retain body 121 in assembled relation on head 113.

When ring 149 is rotated, it moves rollers 141, 142 and 143 in pockets 126, 127 and 128. Counterclockwise rotation of ring 149 locates rollers 141, 142 and 143 in the ends of pockets 126, 127 and 128 adjacent walls 131, 134 and 138 as shown in FIG. 19. When handle 111 is moved in the counterclockwise direction, as shown by arrow 150 in FIG. 19, body 121 is driven by the turning head 113 because rollers 141, 142 and 143 are wedged between ramps 129, 133 and 137 and head inside wall 116. Moving handle 111 in the opposite direction, shown by arrow 115, unlocks rollers 141, 142 and 143 from the drive positions and allows handle 111 to be moved without driving body 121. Handle 111 can be arcuately moved or oscillated in opposite directions to rotate body 121 and drive member 148 in one direction. Rollers 141, 142 and 143 are free to lock on any portions of cylindrical surface 116 to provide the person with a precise feel and performance in tight or close spaces. Rollers 141, 142 and 143 eliminate backlash found in conventional pawl and ratchet teeth drives.

Clockwise rotation of ring 149 moves rollers 141, 142 and 143 adjacent end walls 132, 136 and 139 and in driving engagement with ramps 129, 133 and 137 and inside wall 116. Clockwise movement of handle 111, shown by arrow 160 in FIG. 17, causes rollers 141, 142 and 143 to wedge between ramps 129, 133 and 137 and inside wall 116 of head 113 thereby turning body 121 with handle 111 . Moving handle 111 in the opposite direction, shown by arrow 165, unlocks rollers 141, 142 and 143 from their drive positions and allows handle 111 to be moved without driving body 121. Reciprocating or stroking handle 111 in opposite directions will cause body 121 to be driven in one direction according to the positions of rollers 141, 142 and 143 as determined by the angular location of ring 149.

The position of ring 149 relative to body 121 is controlled with releasable holders, shown as spring biased detents, having three pair of recesses 169, 172 and 170, 173 and 171, 174 and plungers 176, 177 and 178 that selectively fit into one of each pair of recesses. As shown in FIG. 14, plunger 176 is located in a blind bore 179 and biased up in recess 169 with a coil spring 181. The upper end of plunger 177 has a semi-hemispherical shape so that on rotation of ring 149 plunger 177 will release from recess 169 and move into recess 172. Plungers 176 and 178 have the same structure as plunger 177 and are located in blind bores accommodating biasing springs. Plungers 176, 177 and 178 releasably retain ring 149 in either a first position or a second position to selectively locate rollers 141, 142 and 143 in clockwise and counterclockwise lock positions.

Returning to FIGS. 14 and 15, body 121, stem 148 and boss 166 have an upright bore 182 with an internal shoulder 188. A stem 183 having a shoulder 184 in the upper end thereof is located within bore 182. Coil spring 187 located in bore 182 abuts against shoulder 188 and a shoulder 184 on stem 183 biases stem 183 upward to a socket lock position. The drive member 148 has a tapered side hole 191 accommodating a ball 192. An annular lip 185 retains ball 192 in hole 191 and holds stem 183 in assembled relation with body 121. The inside curved part of ball 192 fits into one of two recesses 193 and 194 in stem 183. When stem 183 is in its up or lock position, ball 192 is located in recess 193. The outer part of ball 192 extends laterally from drive member 148. Ball 192 cooperates with an internal recess in a socket to hold the socket on drive member 148. When stem 183 is pushed down, as indicated by arrow 195 in FIG. 15, recess 194 is aligned with ball 192 so that ball 192 is free to move into drive member 148. The socket can be removed from drive member 148 since ball 192 does not hold the socket on drive member 148. When the force on stem 183 has been removed, spring 187 biases stem 183 upwardly thereby moving ball 192 to the out lock position.

In use stem 183 is moved down to allow a socket or another device for turning a nut or bolt head to be placed on drive member 148. When the force on stem 183 has been removed, stem 183 is moved up by spring 187 causing ball 192 to move out to lock socket on drive member 148. The clockwise or counterclockwise direction of the drive of member 148 is determined by the angular position of ring 149 which controls the locations of rollers 141, 142 and 143 in pockets 126, 127 and 128. As shown in FIG. 19, when rollers 141, 142 and 143 are in the left end of pockets 126, 127 and 128, the drive rotation of handle 111 and body 121 is counterclockwise. This will release a right hand threaded nut from its associated bolt or stud. As shown in FIG. 17, when rollers 141, 142 and 143 are in the right end of pockets 126, 127 and 128, the drive rotation of handle 111 and body 121 is clockwise. This will tighten a right hand threaded nut on to its associated bolt or stud. Handle 111 can be moved in the opposite direction without turning body 121 and the socket on member 148 because rollers 141, 142 and 143 are released from driving engagement with ramps 129, 133 and 137 and inside surface 116 of head 113. The amount of reciprocating arcuate movement of handle 111 can vary as rollers 141, 142 and 143 can lock in engagement with any circumferential portions of inside surface 116 of head 113. The operation of tool 100 is infinitely variable as there are no ratchet teeth and pawls in the drive mechanism that control the amount of reciprocating arcuate movement of handle 111 of the tool. Tool 100 is useable in small and tight spaces since small amounts of movement of handle 111 will drive body 121 and drive member 148 to turn a nut or bolt in selected opposite directions.

Figure 23:
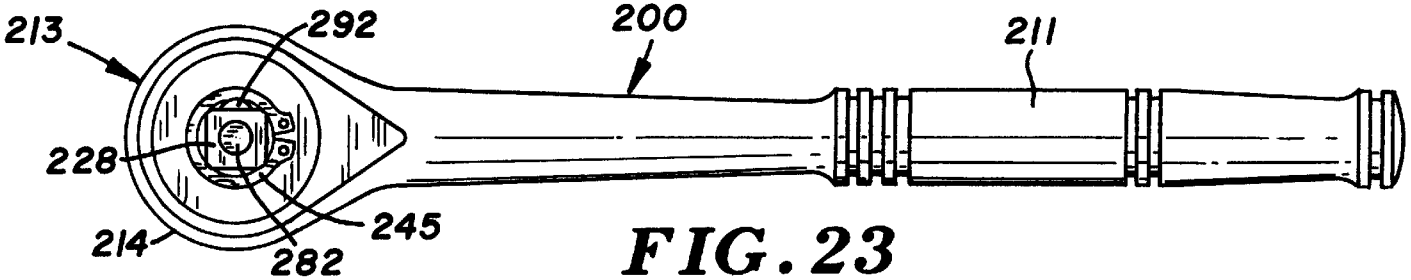
FIG. 23 is a bottom plan view of FIG. 21.
Figure 24:
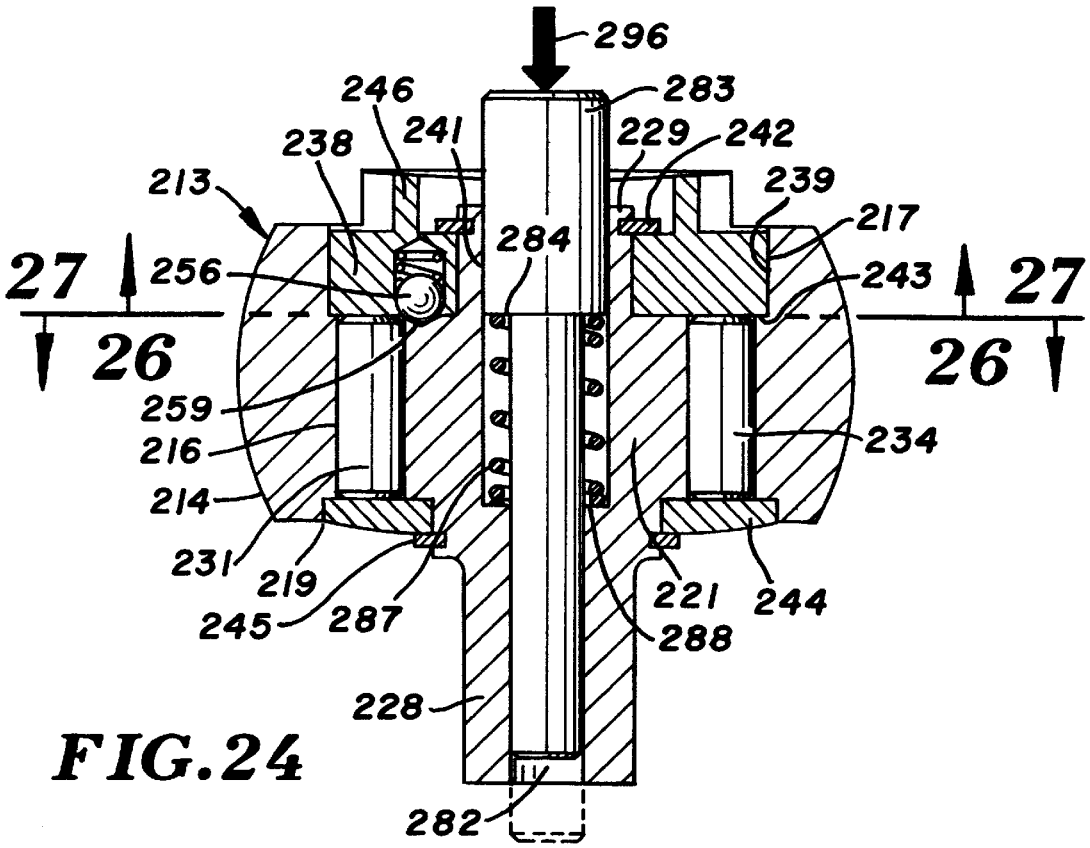
FIG. 24 is an enlarged sectional view taken along the line 24—24 of FIG. 21.
Figure 25:
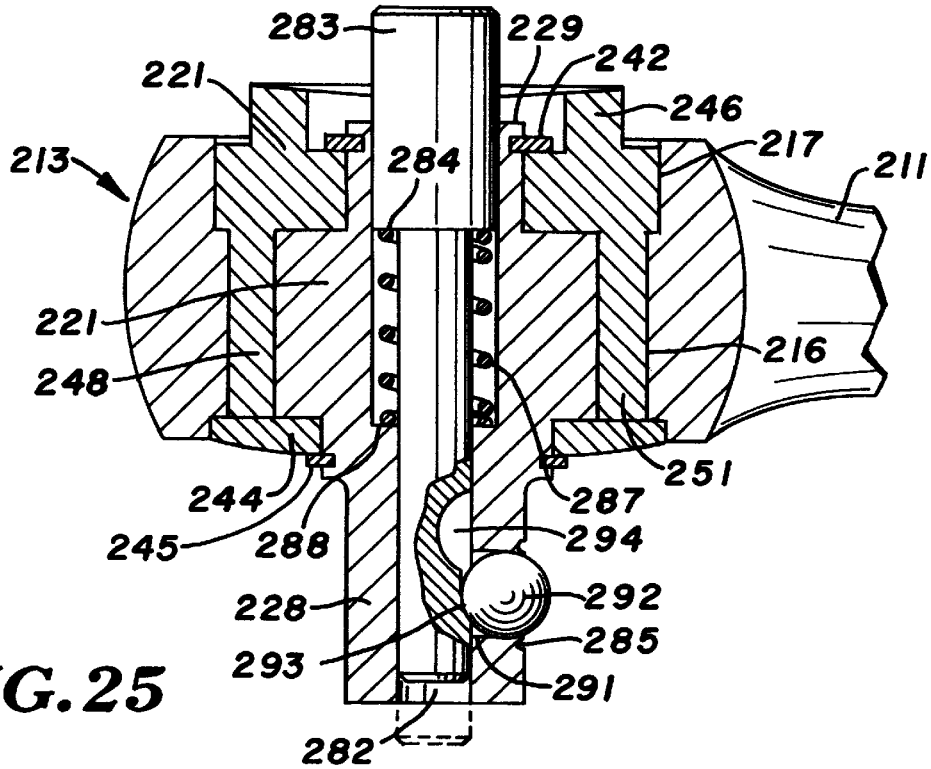
FIG. 25 is an enlarged sectional view taken along the line 25—25 of FIG. 22.
Figure 26:
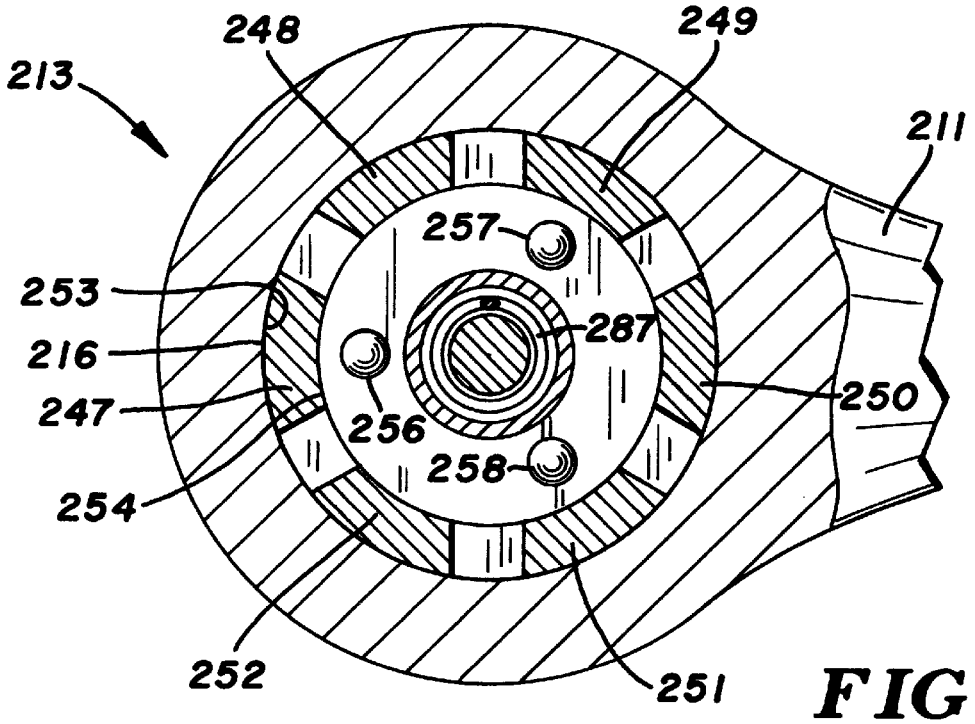
FIG. 26 is a sectional view taken along the line 26—26 of FIG. 24.

A second modification of the hand tool, indicated generally at 200, is shown in FIGS. 21 to 30. Tool 200 has an elongated tubular handle 211 with a hand grip outer surface at the outer end thereof. A cylindrical head 213 is joined to the inner end of handle 211. Head 213 has a convex outer surface 214 and an inner or inside cylindrical first surface 216 and in inside cylindrical second surface 217. Surfaces 216 and 217 are concentric with the transverse center line or vertical axis of head 213. The diameter of surface 217 is larger than the diameter of surface 216. A first annular shoulder 218 is located between surfaces 216 and 217. As seen in FIG. 24, the bottom of head 213 has an annular recess forming a second annular shoulder 219 accommodating the outer edge of a washer 244. An internal split ring 245 holds washer 244 on head 213.

Figure 27:
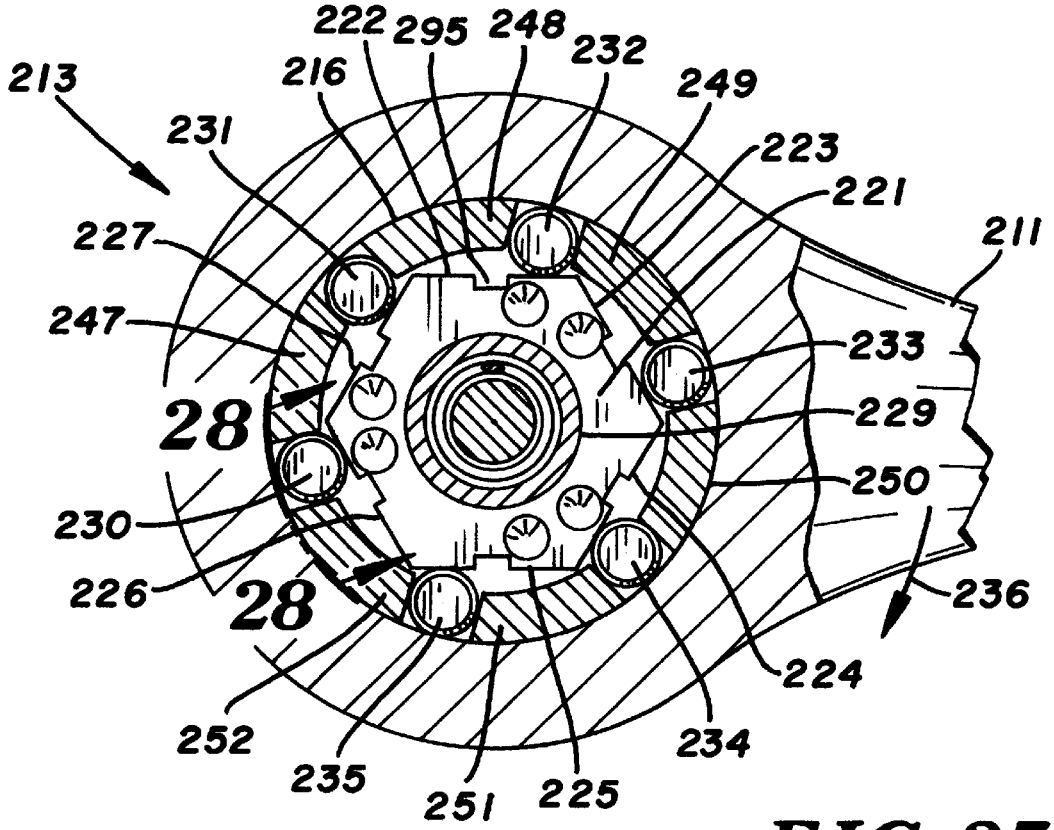
FIG. 27 is a sectional view taken along the line 27—27 of FIG. 24 showing the lock positions of the rollers for clockwise driving of the tool.
Figure 28:
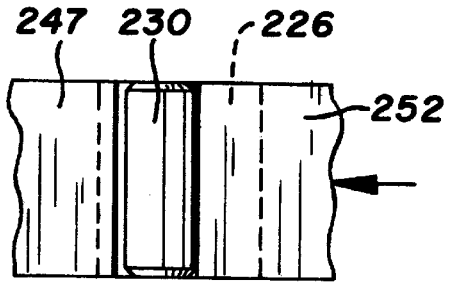
FIG. 28 is an enlarged sectional view taken along the line 28—28 of FIG. 27.

As seen in FIGS. 27 and 28, a rotatable body 221 located within head 213 has six outer flat ramps 222, 223, 224, 225, 226 and 227. Each ramp 222–227 extends along a chord of body 221. The middle portions of ramps 222–227 have generally U-shaped grooves or notches 295 providing recesses for the rollers 230–235. Each groove 295 extends parallel to the axis of rotation of body 221 and axis of rotation of rollers 230–235. Ramps 222–227 can have additional grooves for the rollers in large sized wrenches. Grooves 295 accommodate the rollers 230–235 to prevent inadvertent shifting of the rollers 230–235 to reverse drive positions. When rollers 230–235 are in grooves 295 the outer surfaces of rollers 230–235 disengage the inside surface of the head 213 thereby relieving the wedge forces acting on rollers 230–235. A drive member 228 is joined to the bottom of body 221. As shown in FIG. 23, drive member 228 is square to accommodate a conventional socket. A tubular boss 229 projects upwardly from body 221. Body 221, drive member 228, and boss 229 are a one-piece metal member.

Returning to FIGS. 27 and 29, a plurality of cylindrical rollers 230, 231, 232, 233, 234 and 235 are interposed between body ramps 222–227 and cylindrical surface 216 of head 213. Ramps 222–227 extend along internal chord planes of surface 216 arranged in a hexagonal pattern. When rollers 230–235 are in first positions, shown in FIG. 27, movement of handle 211 in a clockwise direction, shown by arrow 236, causes all of the rollers 230–235 to grip or wedge against cylindrical surface 216 thereby turning body 221 with handle 211. The torque forces and wear on rollers 230–235 and surface 216 in distributed around surface 216. When rollers 230–235 are in second positions, shown in FIG. 29, movement of handle 211 in a counterclockwise direction, shown by arrow 237, causes all of the rollers 230–235 to grip or wedge against cylindrical surface 216 thereby turn body 221 with handle 211. A small stroke actuation of handle 211 activates the gripping of rollers 230–235 to cylindrical surface 216 when enables the tool to be used in confined areas to turn bolts, nuts and threaded devices.

Rollers 230–235 are selectively moved to their first and second positions with a manually turned ring 238. Ring 238 is an annular member having an outer cylindrical surface 239 bearing against surface 217 of head 213 and an inner cylindrical surface 241 riding on boss 229. Ring 238 and washer 244 maintain body 221 within head 213 and the concentric relationship of body 221 with surface 216. A snap ring 242 mounted on boss 229 engages the top of ring 238 to retain body 221 on head 213 and in engagement with annular shoulder 243. Ring 242 has an upright finger grip or tab 246 to facilitate manual turning of ring 238.

Figure 29:
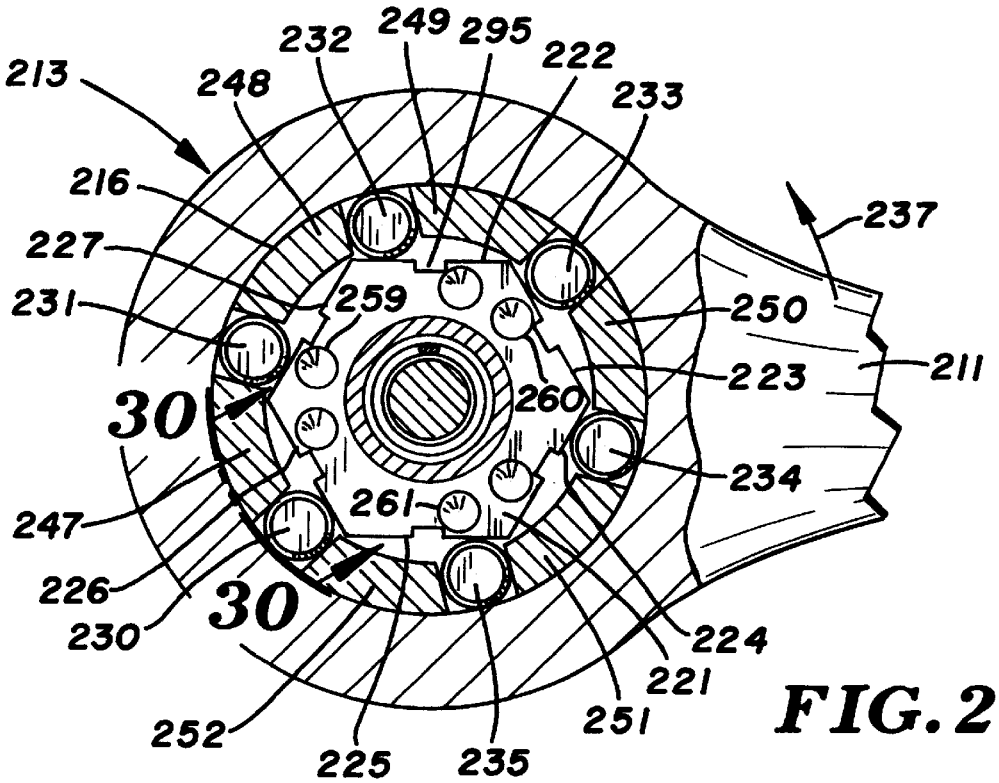
FIG. 29 is a sectional view similar to FIG. 27 showing the lock positions of the rollers for counterclockwise driving of the tool.
Figure 30:
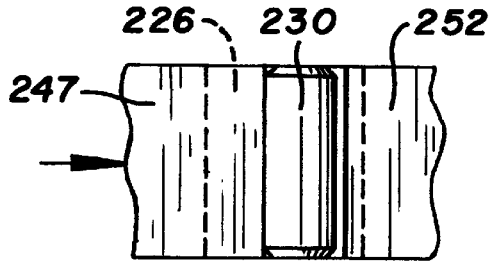
FIG. 30 is an enlarged sectional view taken along the line 30—30 of FIG. 29.

Ring 238 has arcuate segments or members 247, 248, 249, 250, 251 and 252 interposed between adjacent rollers 230–235, as shown in FIGS. 27 and 29. The bottom ends of segments 247–252 are flat and engage washer 244. Segment 247 has an arcuate outer surface 253 located in sliding surface contact with surface 216 and an inner arcuate surface 254. Each segment 248–252 has identical inner and outer surfaces. As shown in FIGS. 27 and 29, the corners of body 221 ride on the inner surfaces of segments 247–252 to further stabilize and maintain the concentric relationship of body 221 with surface 216. When ring 238 is turned relative to head 213, segments 247–252 move rollers 230–235 relative to body 221 to their first and second positions shown in FIGS. 27 and 29.

Three releasable holders or detents 256, 257 and 258, shown as a spring biased ball in FIG. 24, mounted on ring 238 function to selectively hold ring 238 in first and second positions relative to body 221. As shown in FIGS. 27 and 29, the top of body 221 has three pairs of recesses 259, 260 and 261 cooperating with detents 256, 257 and 258 to retain ring 238 in a selected position relative to body 221.

A stem 283 having a shoulder 284 in the upper end thereof is located within a bore 282 through stem 283. Coil spring 287 located in bore 282 abuts against shoulder 288 and shoulder 284 on stem 283 biases stem 283 upward to a socket lock position. Drive member 228 has a tapered side hole 291 accommodating a ball 292. An annular lip 285 partly closes hole 291 and holds stem 283 in assembled relationship with drive member 228. The inside curved part of ball 292 fits into one of two recesses 293 and 294 in stem 283. When stem 283 is in its up or lock position, ball 292 is located in recess 293. The outer part of ball 292 extends laterally from drive member 228. Ball 292 cooperates with an internal recess in a socket to hold the socket on drive member 228. When stem 283 is pushed down, as indicated by arrow 296 in FIG. 24, recess 294 is aligned with ball 292 so that ball 292 is free to move into drive member 228. The socket can be removed from drive member 228 since ball 292 does not hold the socket on drive member 228. When the force on stem 283 has been removed, spring 287 biases stem 283 upwardly thereby moving ball 292 to the out lock position.

Three embodiments of the hand tool of the invention have been described. Changes in the structure, arrangement of parts, the number of ramps and grooves in the ramps can be achieved by one skilled in the art without departing from the invention.

What is claimed is:

1. A hand tool for turning a device comprising: an elongated handle, a head joined to the handle, said head having a top surface, a bottom surface, an inside first cylindrical surface and a second cylindrical surface concentric with the first cylindrical surface extended between said top and bottom surfaces, said second cylindrical surface having a diameter larger than the diameter of the first cylindrical surface and open to said top surface of the head, and an annular recess in said bottom surface having a diameter larger than the diameter of the first cylindrical surface, a body located within said head, a drive member secured to the body for accommodating a device, said body having a plurality of spaced convex outer peripheral surfaces and a plurality of U-shaped recesses providing pockets between the spaced outer peripheral surfaces, said pockets being open to the inside first cylindrical surface of the head, said body having linear ramps at the bottoms of the pockets, said ramps having axially extended grooves in the middle portions thereof and opposite ends, said body having end walls extended normally outward from the opposite ends of the ramps to the outer peripheral surfaces of the body, a roller located in each pocket engageable with one of said ramps and the inside cylindrical surface when the roller is adjacent opposite ends of the pocket and disengageable with the inside cylindrical surface when the roller is moved toward the middle portion of the ramp and when a portion of the roller is located in a groove, ring means mounted on the body for selectively shifting the rollers adjacent to the opposite ends of the pockets whereby oscillating movement of the handle causes intermittent rotation of the body and driven member, said ring means having an outer cylindrical surface located in sliding engagement with the second cylindrical surface to position the ring means on the head, first means mounting the ring means on the body, said ring means being movable between first and second positions to move the rollers adjacent to the opposite ends of the pockets, detent means cooperating with the body and ring means for selectively holding the ring means in the first and second positions, second means attached to the body and extended into the annular recess in the bottom surface of the head to cover the bottom ends of the pockets to confine the rollers to the pockets whereby the ring means and first and second means retain the body with the head, said body and drive member having a vertical bore extended through the body and drive member, said drive member having a lateral hole open to the bore, a ball located in said hole engageable with a device to hold the device on the drive member, a stem located in said bore having a first recess for holding the ball in engagement with the device and a second recess for allowing the ball to move out of engagement with the device, biasing means holding the stem in a position wherein the ball is in the first recess, and means for limiting the movement of the stem relative to the body and drive member, said stem being selectively movable to align the first and second recesses with the ball.

2. The tool of claim 1 wherein: the ring means has a plurality of radial slots facing the body, said rollers having ends extended into the slots whereby selective movement of the ring means between first and second positions moves the rollers adjacent opposite ends of the pockets, each of said slots having a radial length greater than the diameter of the end of the rollers extended into the slot to allow the roller to rotate and radially move relative to the ring means.

3. The tool of claim 1 wherein: the ring means includes pairs of fingers located adjacent opposite sides of each roller to facilitate movement of the rollers adjacent opposite ends of the pockets.

4. The tool of claim 1 wherein: each roller is a cylindrical member, and each combined groove and pocket has a depth greater than the diameter of the cylindrical member and said pocket having depths at its opposite end sections less than the diameter of the cylindrical member.

5. The tool of claim 1 wherein: each pocket has an arcuate length of about 60 degrees.

6. A hand tool for turning a socket comprising: an elongated handle having a longitudinal axis and an end, a head joined to the end, said head having top and bottom surfaces, an opening having an axis extended normal to the longitudinal axis of the handle, an inside continuous first cylindrical surface concentric with the axis of the opening, and a second cylindrical surface larger than and concentric with the first cylindrical surface open to the top surface, a body having a plurality of pockets and circumferentially spaced ramps at the bottom of the pockets, each of said ramps having a single linear surface with a groove in the middle portion thereof extended generally parallel to the axis of the opening and opposite ends, and end walls extended from opposite ends of the ramps to the first cylindrical surface, arcuate surfaces between the ends walls of each pocket located in sliding rotational engagement with the first cylindrical surface, a drive member secured to the body for accommodating a socket, roller means engageable with the ramps and first cylindrical surface for selectively locking the head and body whereby when the handle is turned the body and drive member are rotated, each of said roller means when located in the groove being spaced from the first cylindrical surface, ring means mounted on the body for movement between first and second positions for selectively shifting the roller means adjacent to opposite ends of said pockets whereby oscillating movement of the handle causes intermittent rotation of the body and drive member, said ring means having an outer peripheral cylindrical surface located in sliding engagement with the second cylindrical surface, first means mounting the ring means on the body, detent means cooperating with the body and the ring means for selectively holding the ring means in the first and second positions, and second means attached to the body and engageable with the bottom surface of the head to confine the roller means between the ramps and cylindrical surface whereby the ring means and first and second means retain the body within the head.

7. The tool of claim 6 including: an annular shoulder located between said first and second cylindrical surfaces, said ring means having an annular outer edge engageable with said shoulder.

8. The tool of claim 6 wherein: the ring means comprises a ring mounted on the body and members secured to the ring engageable with the roller means to move the roller means adjacent to the opposite ends of the pockets.

9. The tool of claim 8 wherein: the members are pair of fingers located adjacent opposite sides of each roller means.

10. The tool of claim 6 wherein: the roller means are cylindrical members, said combined pockets and grooves have a depth greater than the diameter of the cylindrical members and said pockets having depths at their opposite end sections less than the diameter of the cylindrical members.

11. The tool of claim 6 wherein: the body and drive member have a bore extended through the body and drive member, said drive member having a lateral hole open to the bore, a ball located in said hole engageable with a socket to hold the socket on the drive member, a stem located in said bore having a first recess for holding the ball in engagement with the socket and a second recess for allowing the ball to move out of engagement with the socket, biasing means holding the stem in a position wherein the ball is in the first recess, and means for limiting the movement of the stem relative to the body and drive member, said stem being selectively movable to align the first and second recesses with the ball.

12. The tool of claim 6 wherein: the ring means has a plurality of radial slots facing the body, said rollers having ends extended into the slots, each of said slots having a radial length greater than the diameter of the end of the roller extended into the slot to allow the roller to rotate and radially move relative to the ring means.

13. A hand tool for turning a device comprising: an elongated handle having a longitudinal axis, a head joined to the handle, said head having an opening with an axis extended normal to the longitudinal axis of the handle and an inside continuous cylindrical surface concentric with the axis of the opening, a body located within said head, a drive member secured to the body for accommodating a device, said body having a plurality of ramps facing the inside cylindrical surface, each of said ramps having a single linear surface with a groove in the middle portion thereof extended generally parallel to the axis of the opening and opposite ends, a roller located between each ramp and the inside continuous cylindrical surface and engageable with said single linear surface and the inside continuous cylindrical surface when the roller is adjacent opposite ends of the ramp and disengageable with the inside cylindrical surface when the roller is moved toward the middle portion of the single linear surface of the ramp and when the roller is located in the groove, ring means mounted on the body for selectively shifting the roller adjacent to the opposite ends of the ramp whereby oscillating movement of the handle causes intermittent rotation of the body and drive member, said ring means having arcuate segments located between adjacent rollers, said segments having outer surfaces located in surface engagement with the inside continuous cylindrical surface of the head, and means for holding the body on the head, the rollers between the single linear surface and continuous cylindrical outer surface, and the ring means for selectively shifting the rollers on the body and head.

14. The tool of claim 13 wherein: the inside cylindrical surface is a first inside cylindrical surface, the head having a second inside cylindrical surface concentric with and located adjacent the first inside cylindrical surface, said ring means mounted on the body for selectively shifting the rollers adjacent to the opposite ends of the pockets including a ring mounted on the body having a surface engageable with the second cylindrical surface for arcuate movement between first and second positions.

15. The tool of claim 14 including: detent means cooperating with the body and ring for selectively holding the ring in the first and second positions.

16. The tool of claim 15 wherein: the detent means comprises a plurality of plungers movably mounted on the body, pairs of circumferentially spaced recesses in the ring facing the body accommodating each plunger, and means for biasing the plungers into said recesses for selectively and releasably holding the ring in the first and second positions.

17. The tool of claim 13 wherein: each ramp has a linear surface extended along a chord line of the body.

18. The tool of claim 13 wherein: each roller is a cylindrical member, and each combined ramp and groove has a depth greater than the diameter of the cylindrical member whereby the cylindrical member is spaced from the cylindrical surface of the head and each ramp being spaced at its opposite end sections a distance less than the diameter of the cylindrical member.

19. The tool of claim 13 wherein: the body and drive member have a bore extended through the body and drive member, said drive member having a lateral hole open to the bore, a ball located in said hole engageable with a device to hold the device on the drive member, a stem located in said bore having a first recess for holding the ball in engagement with the device and a second recess for allowing the ball to move out of engagement with the device, biasing means holding the stem in a position wherein the ball is in the first recess, and means for limiting the movement of the stem relative to the body and drive member, said stem being selectively movable to align the first and second recesses with the ball, said drive member having annular means engageable with the ball to hold the ball in the hole and retain the stem in movable relationship with the body and drive member.

20. The tool of claim 19 wherein: the annular means engageable with the ball comprises an annular lip on the drive member partly closing the hole to hold the ball in the hole and retain the stem in assembled relationship with the drive member.

21. The tool of claim 19 wherein: the stem has a cylindrical head projected upwardly from the body whereby the stem can be manually moved to align the ball with the second recess whereby the device can be removed from the drive member.

22. The tool of claim 13 wherein: said body has six ramps located in a hexagonal shape.

23. The tool of claim 13 wherein: said segments include inner surfaces, said ramps having portions at the opposite ends located in contiguous relationship with said inner surfaces of the segments.

24. A hand tool for turning a device comprising: an elongated handle having a longitudinal axis, a head joined to the handle, said head having an opening with an axis extended normal to the longitudinal axis of the handle and an inside continuous cylindrical surface concentric with the axis of the opening, a body located within said head, a driven member secured to the body for accommodating a device, said body having a plurality of pockets open to the inside continuous cylindrical surface and ramps at the bottoms of the pockets, each of said ramps having a single linear surface with a groove in middle portions thereof extended generally parallel to the axis of the opening and opposite ends, and end walls extended from the opposite ends of the ramps to said cylindrical surface, arcuate surfaces between the end walls of each pocket located in sliding engagement with the cylindrical surface, a roller located in each pocket engageable with said single linear surface and the inside continuous cylindrical surface when the roller is adjacent opposite ends of the ramp and disengageable with the inside continuous cylindrical surface when the roller is moved toward the middle portion of the linear surface and when a portion of the roller is located in the groove in the linear surface of the ramp, means mounted on the body for selectively shifting the rollers adjacent to the opposite ends of the ramps whereby oscillating movement of the handle causes intermittent rotation of the body and driven member, and means for holding the body on the head, the rollers in said pockets, and means for selectively shifting the rollers on the body and head.

25. The tool of claim 24 wherein: each roller is a cylindrical member, and each pocket has a depth at their midsection greater than the diameter of the cylindrical member and depths at their opposite end sections less than the diameter of the cylindrical member.

26. The tool of claim 24 wherein: the body and driven member have a bore extended through the body and driven member, said driven member having a lateral hole open to the bore, a ball located in said hole engageable with a device to hold the device on the driven member, a stem located in said bore having a first recess for holding the ball in engagement with the device and a second recess for allowing the ball to move out of engagement with the device, biasing means holding the stem in a position wherein the ball is in the first recess, and means for limiting the movement of the stem relative to the body and driven member, said stem being selectively movable to align the first and second recesses with the ball.

27. A hand tool for turning a socket comprising: an elongated handle having a longitudinal axis and an end, a head joined to the end, said head having an opening with an axis extended normal to the longitudinal axis of the handle and an inside continuous first cylindrical surface concentric with the axis of the opening and an inside second cylindrical surface concentric with the first cylindrical surface, a body having a plurality of circumferentially spaced pockets open to the first cylindrical surface, ramps at the bottom of the pockets, and arcuate surfaces between the pockets located in sliding rotational engagement with the first cylindrical surface, each of said ramps having a single linear surface with a groove in the middle portion thereof extended generally parallel to the axis of the opening and opposite ends, and end walls extended from the opposite ends of the ramps to said cylindrical surface, arcuate surfaces between the end walls of each pocket located in sliding engagement with the cylindrical surface, a drive member secured to the body for accommodating a socket, roller means located in each pocket engageable with the single linear surface and continuous first cylindrical surface for selectively locking the head and body whereby when the handle is turned the body and drive member are rotated, and disengageable with the inside continuous cylindrical first surface when the roller is moved to the middle portion of the linear surface and when a portion of the roller is located in the groove in the linear surface of the ramp, ring means mounted on the body adjacent the second cylindrical surface for selectively shifting the roller means in said pockets adjacent to the opposite ends of the ramps whereby oscillating movement of the handle causes intermittent rotation of the body and drive member, and means for holding the body on the head, the roller means in said pockets, and the ring means for selectively shifting the roller means in said pockets on the body and head.

28. The tool of claim 27 wherein: each ramp has a linear surface extended along a chord line of the body.

29. The tool of claim 27 including: detent means cooperating with the body and ring means for selectively holding the ring means in a first position and a second position wherein the roller means are retained adjacent opposite ends of the pockets.

30. The tool of claim 27 wherein: the roller means are cylindrical members, said pockets having a depth at their mid sections greater than the diameter of the cylindrical members and depths at their opposite end sections less than the diameter of the cylindrical members.

31. The tool of claim 27 wherein: the body and drive member have a bore extended through the body and drive member, said drive member having a lateral hole open to the bore, a ball located in said hole engageable with a socket to hold the socket on the drive member, a stem located in said bore having a first recess for holding the ball in engagement with the socket and a second recess for allowing the ball to move out of engagement with the socket, biasing means holding the stem in a position wherein the ball is in the first recess, and means for limiting the movement of the stem relative to the body and drive member, said stem being selectively movable to align the first and second recesses with the ball.

* * * * *